United States Patent [19]

Joseph et al.

[11] Patent Number: 4,566,992

[45] Date of Patent: Jan. 28, 1986

[54] SOLUTIONS FOR THE FUSION OF ONE METAL TO ANOTHER

[75] Inventors: Ady Joseph, Islington; Lily Mayer, Etobicoke; Alexander Miutel, Toronto, all of Canada

[73] Assignee: Metafuse Limited, Ontario, Canada

[21] Appl. No.: 335,282

[22] Filed: Dec. 28, 1981

[51] Int. Cl.[4] ..... H01B 1/14

[52] U.S. Cl. ..... 252/518; 252/500; 252/512; 252/513; 252/514

[58] Field of Search ..... 252/518, 512, 513, 514, 252/500

[56] References Cited

U.S. PATENT DOCUMENTS

| | | | |
|---|---|---|---|
| 2,215,102 | 9/1940 | Hesse | 204/5 |
| 2,445,177 | 7/1948 | Lindblad | 117/93 |
| 2,811,484 | 10/1957 | De Long | 204/55 |
| 3,097,291 | 7/1963 | Adcock | 219/76 |
| 3,277,266 | 10/1966 | Blaszkowski | 219/76 |
| 3,277,267 | 10/1966 | Blaszkowski | 219/76 |
| 3,524,956 | 8/1970 | Rocklin | 219/76 |
| 3,741,426 | 6/1973 | Inoue | 219/76 |
| 3,746,627 | 7/1973 | Rapids | 204/15 |
| 3,832,514 | 8/1974 | Antonov | 219/76 |
| 3,865,697 | 2/1975 | Suggs | 204/15 |
| 4,159,934 | 7/1979 | Kadija | 204/224 R |
| 4,205,211 | 5/1980 | Serlin et al. | 219/76.13 |
| 4,220,504 | 9/1980 | Hanley et al. | 204/15 |

*Primary Examiner*—Paul Lieberman
*Assistant Examiner*—Robert A. Wax
*Attorney, Agent, or Firm*—Cushman, Darby & Cushman

[57] ABSTRACT

A soluion for the fusion of a second metal to a first metal which comprises 0.10 to 10% of the second metal in a dissociable form; and a solvent chosen from the group comprising water, an organic solvent or a mixture thereof, the solution having a conductivity in the range 10 to 80 ohms cm.

19 Claims, 52 Drawing Figures

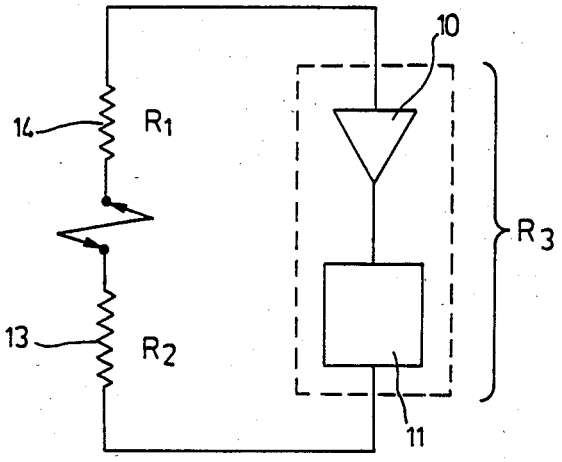
FIG. 3.
FIG. 4.
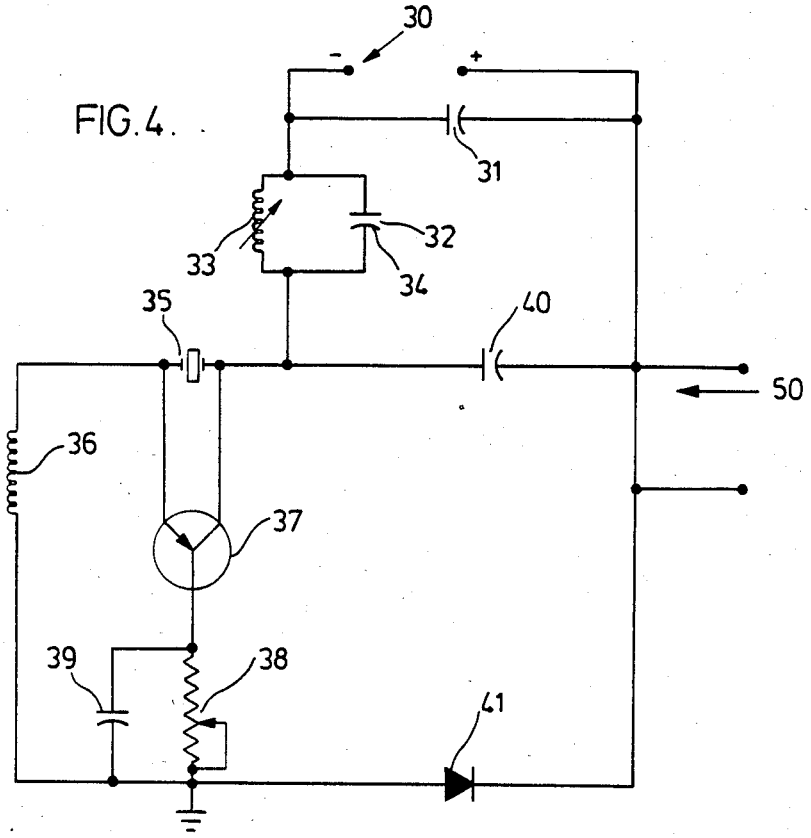

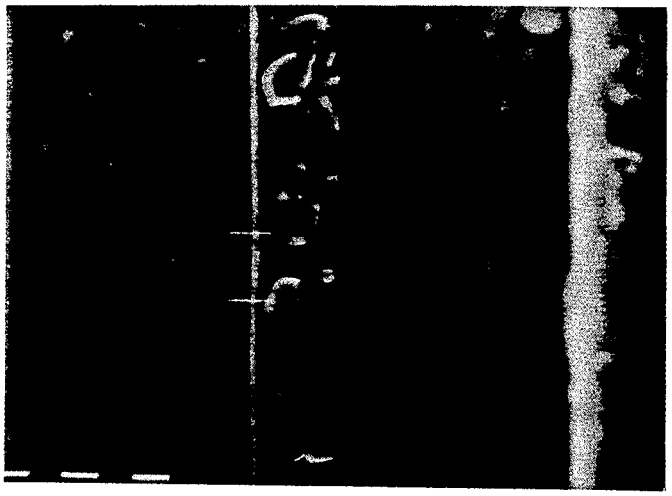
FIG. 5.
FIG. 6.
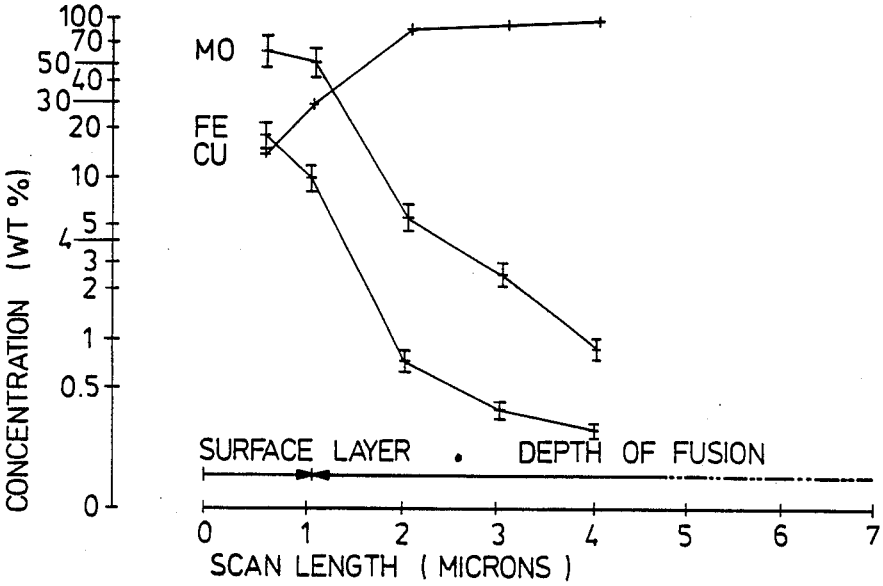

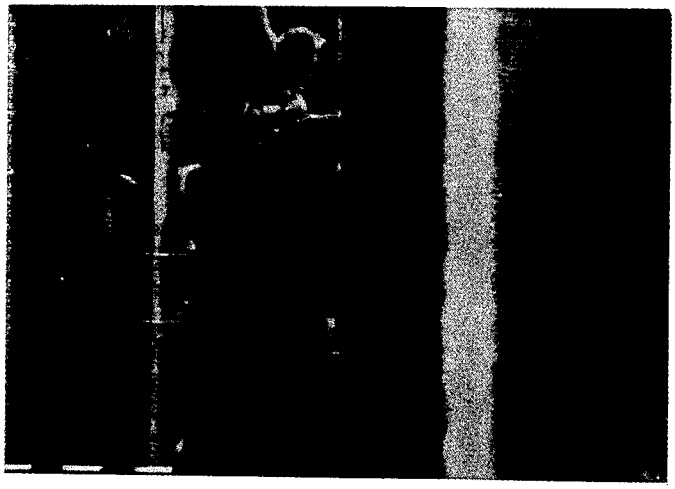
FIG. 7.
FIG. 8.
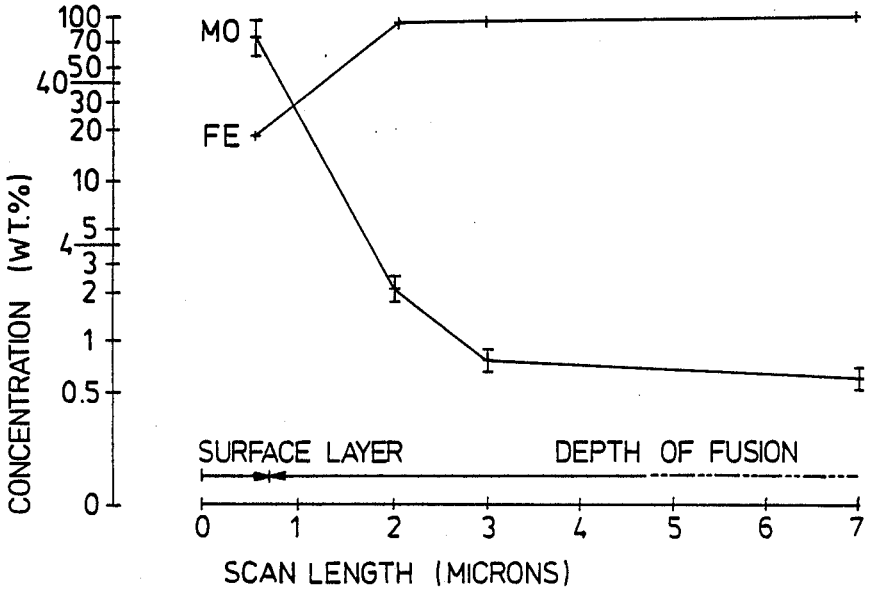

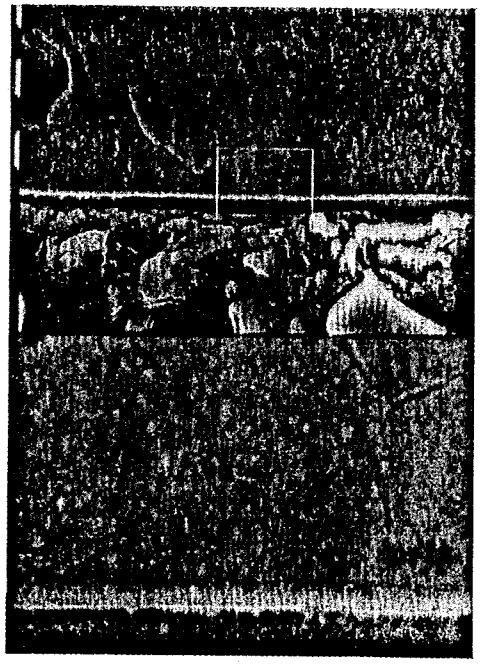
FIG.9.
FIG.10.
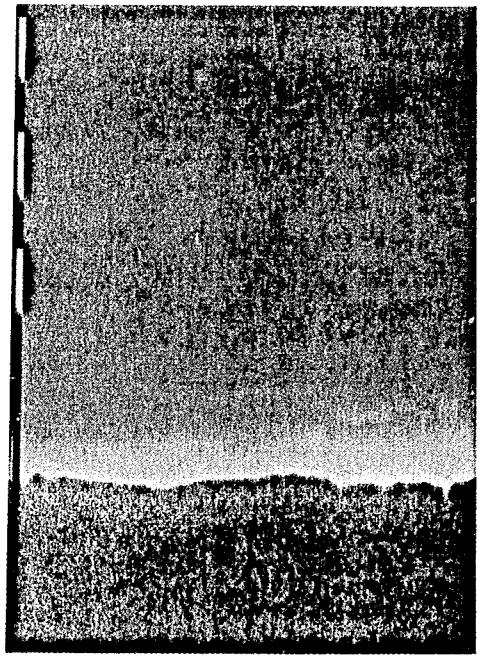

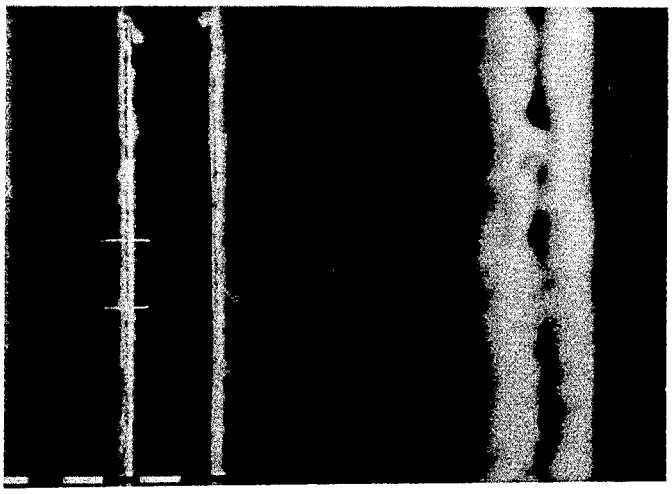
FIG. 12.
FIG. 13.
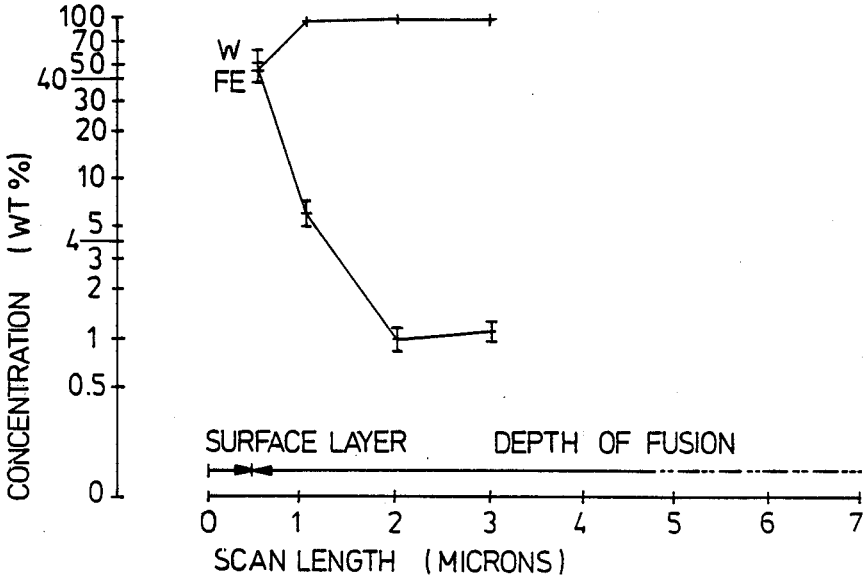

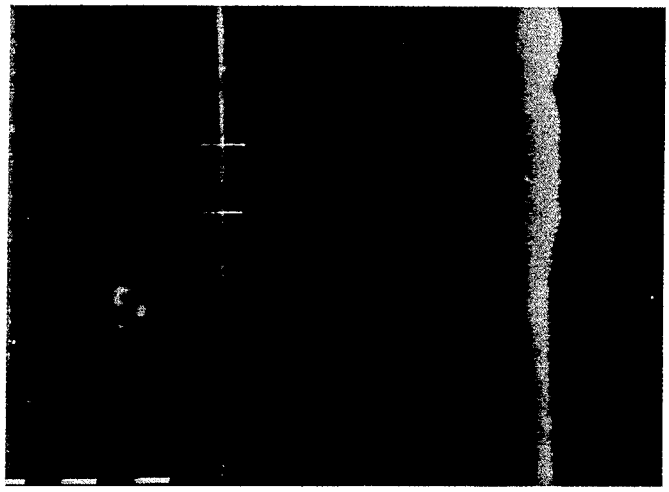
FIG. 14.
FIG. 15.
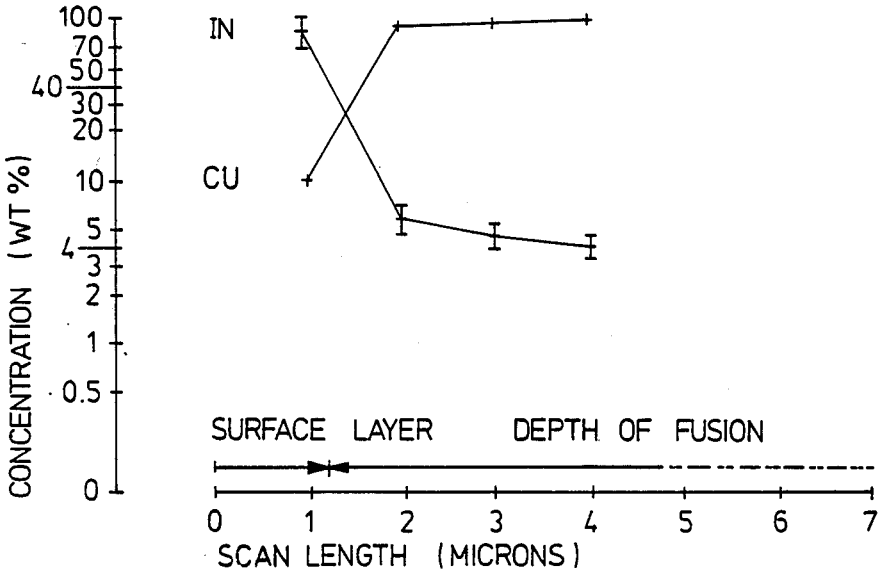

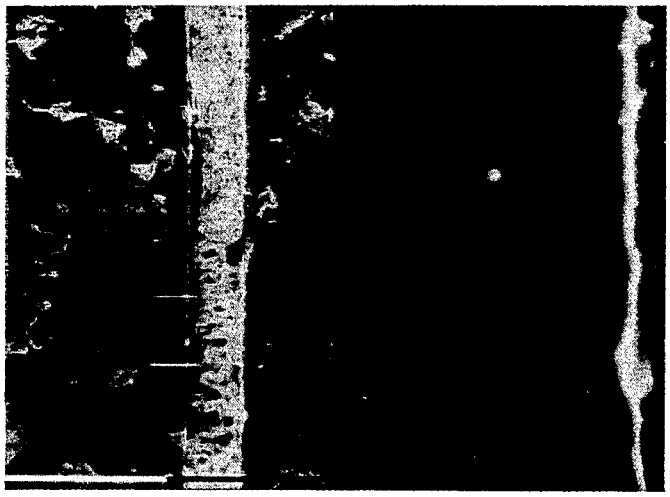
FIG. 16.
FIG. 17.
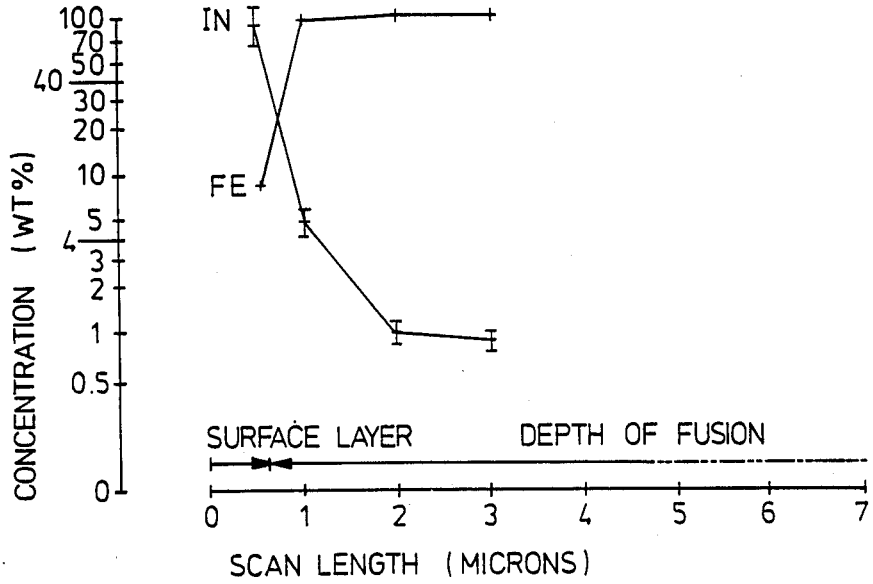

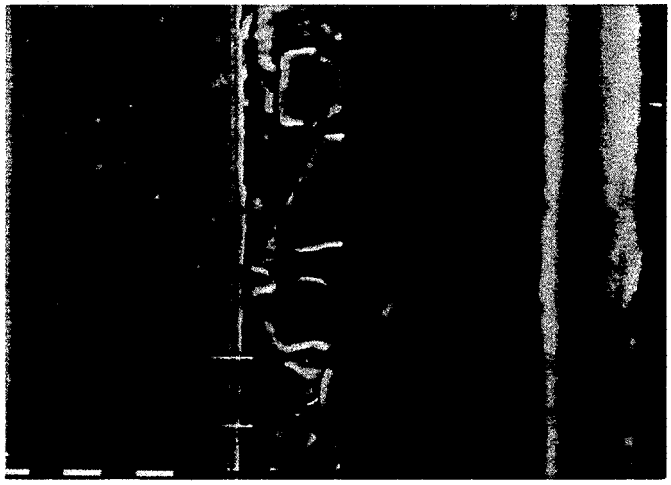
FIG.18.
FIG.19.
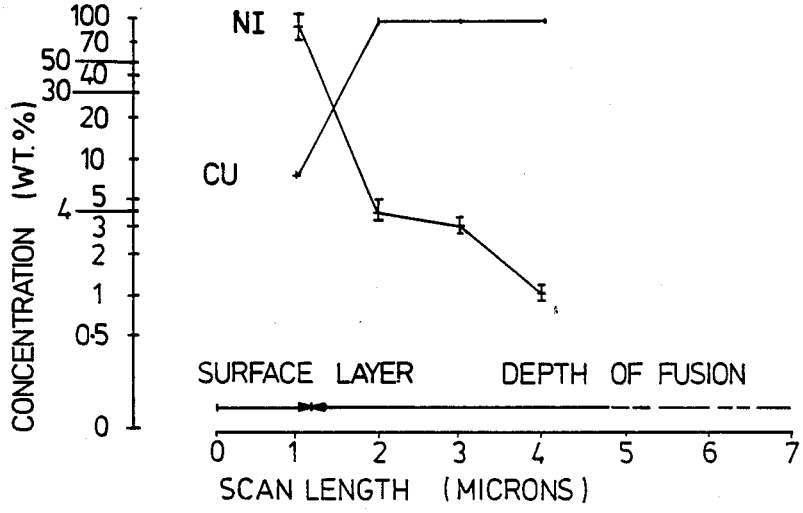

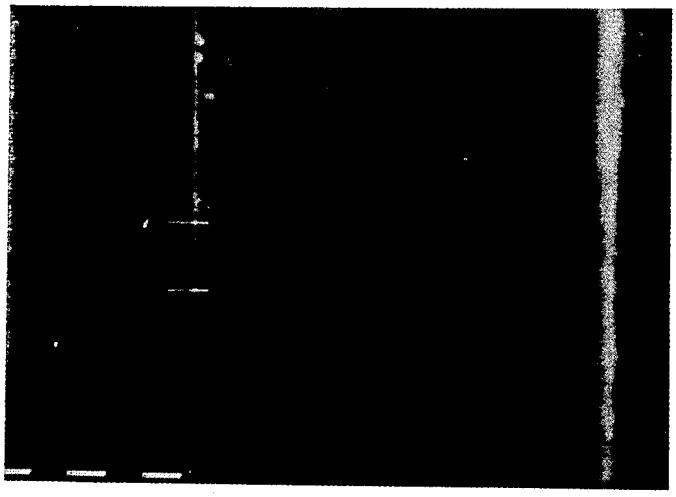
FIG. 20.
FIG. 21.
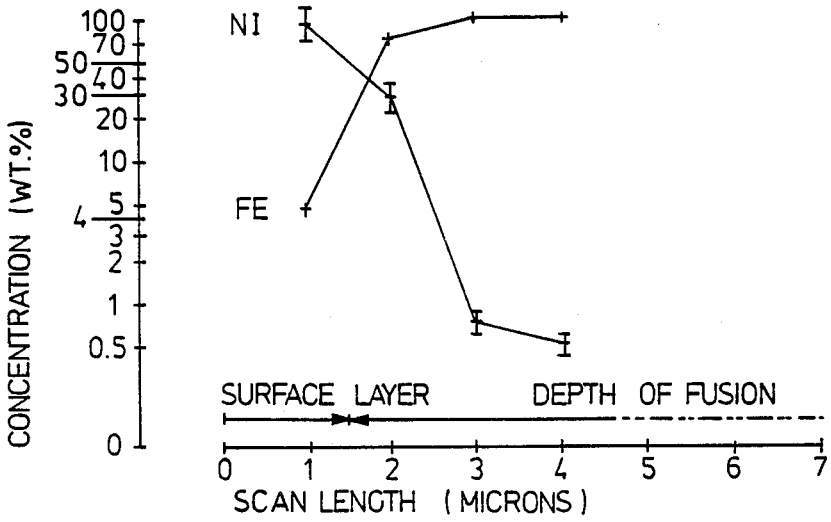

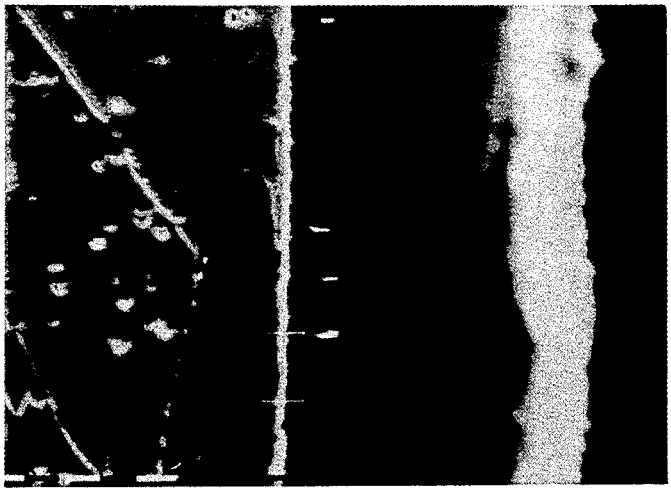
FIG. 22.
FIG. 23.
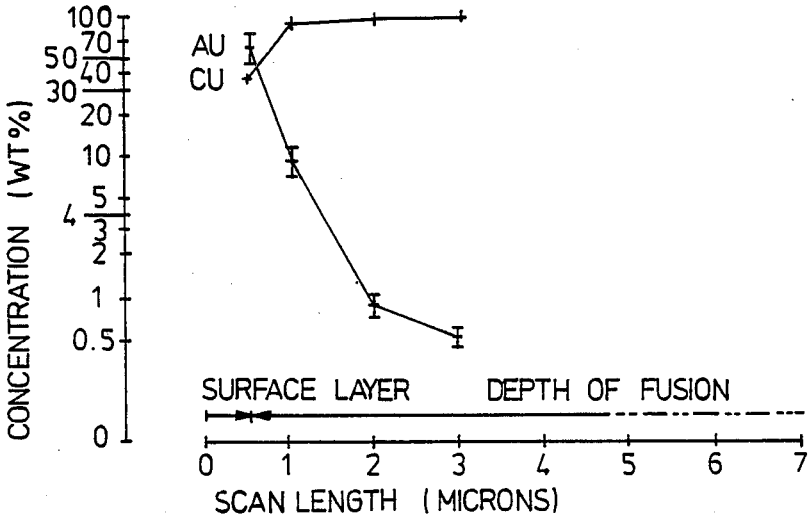

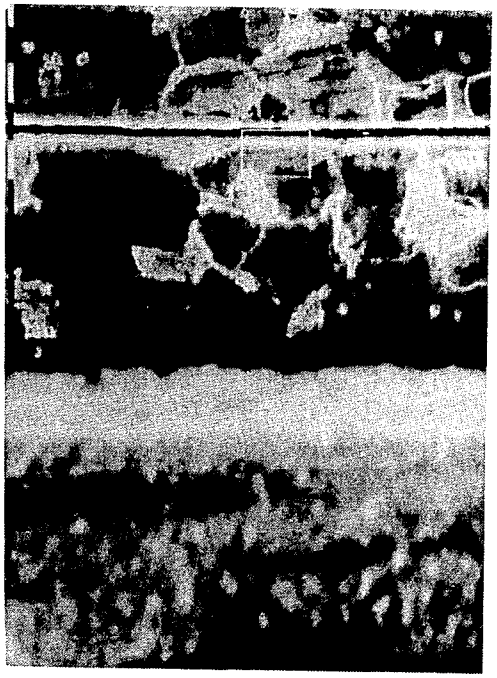
FIG. 24.
FIG. 25.
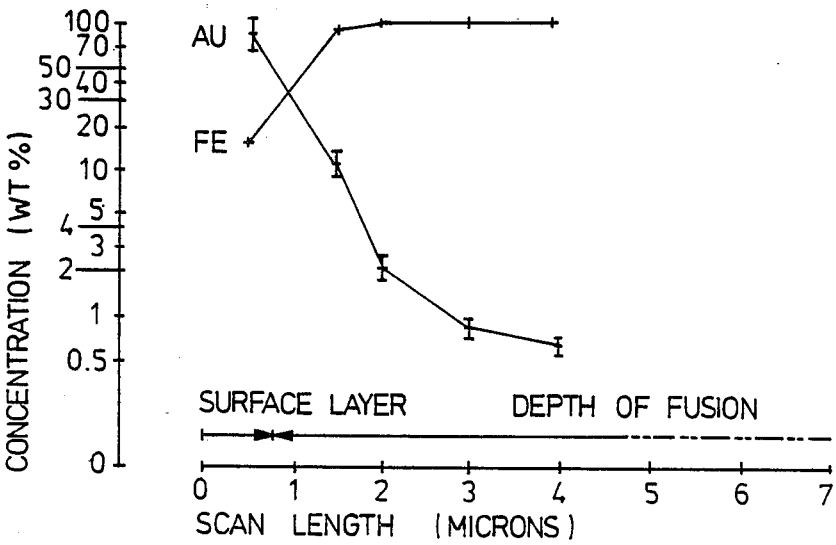

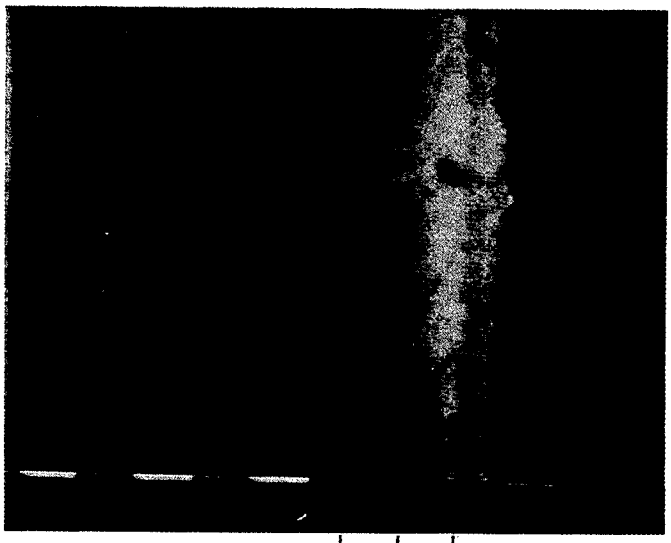
3μm 2μm 1μm
FIG. 26.
FIG. 27.
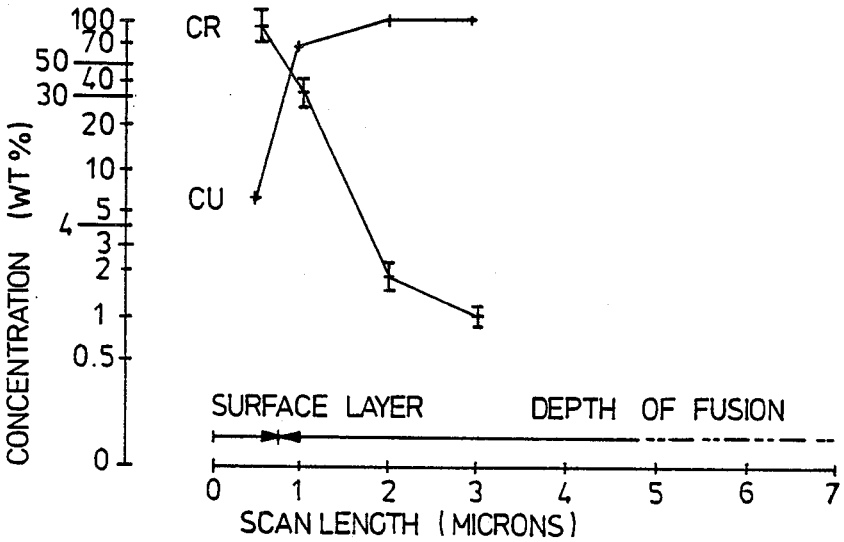

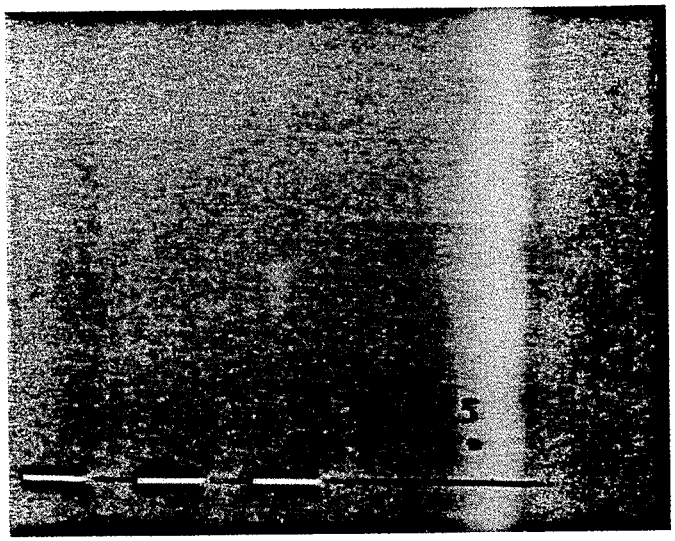
FIG.28.
FIG.29.
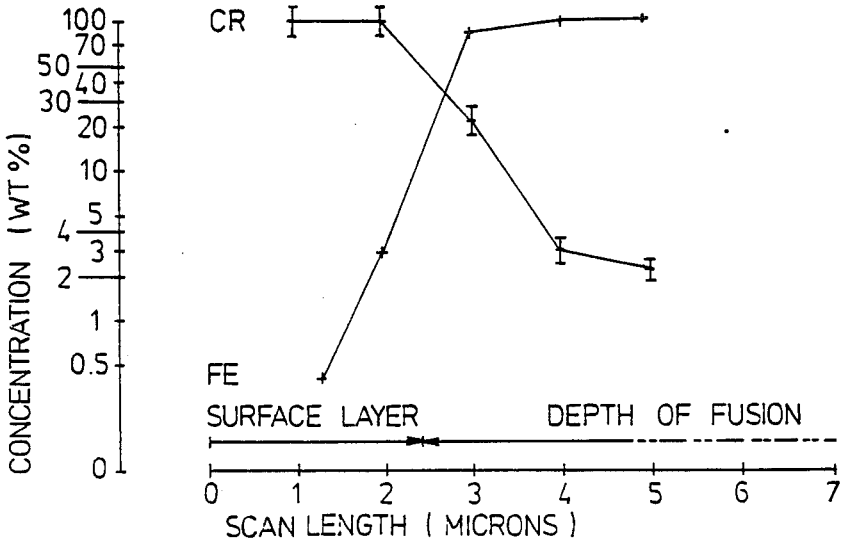

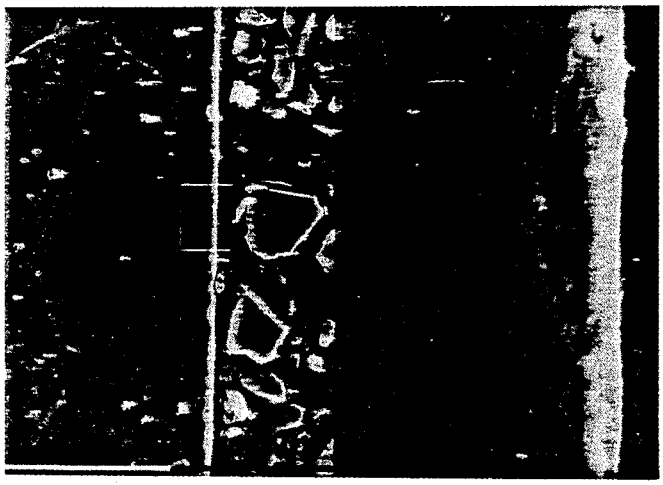
FIG.30.
FIG.30A.
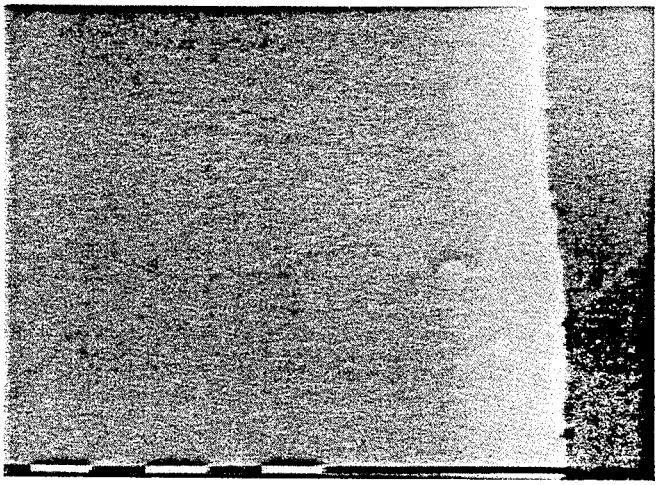

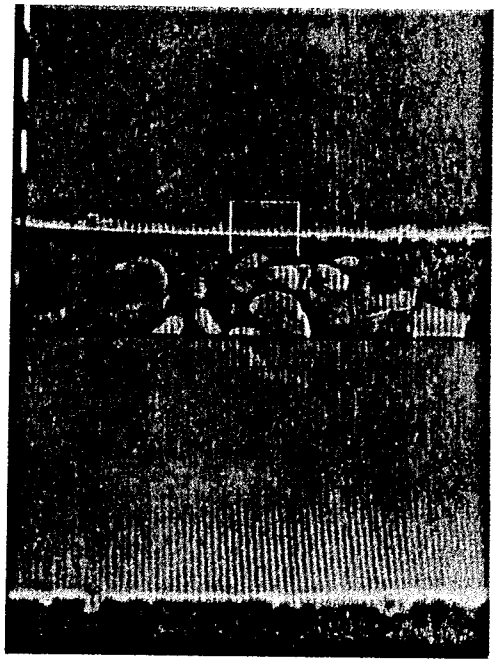
FIG. 32.
FIG. 32A.
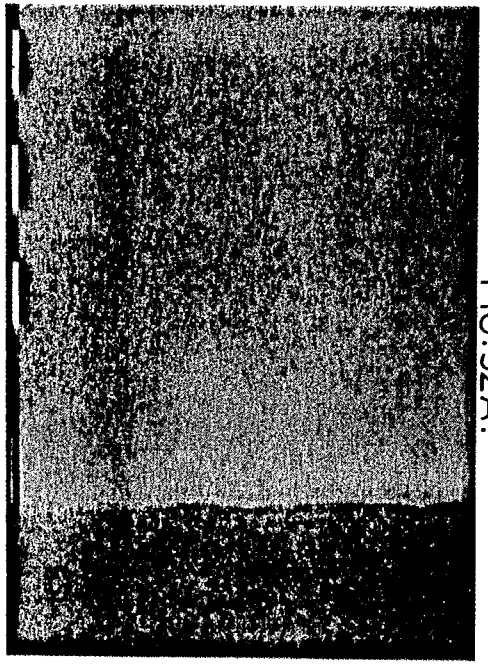

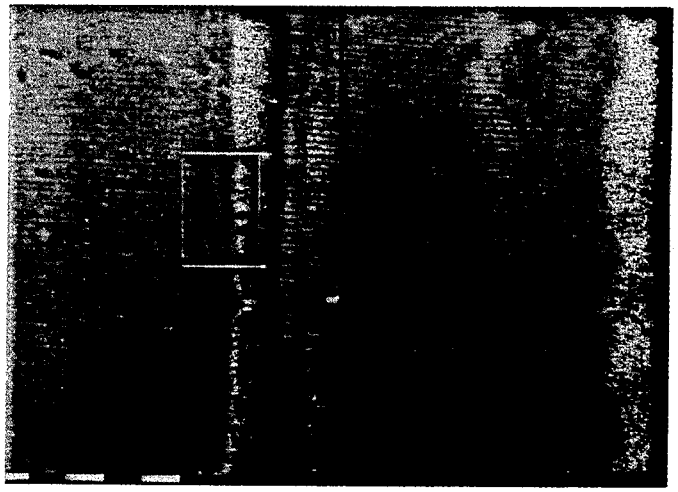
FIG. 34.
FIG. 35.
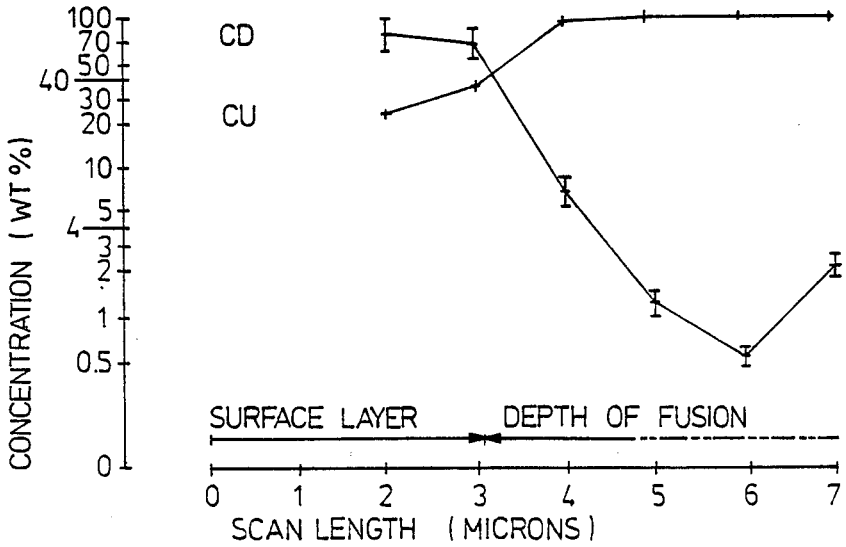

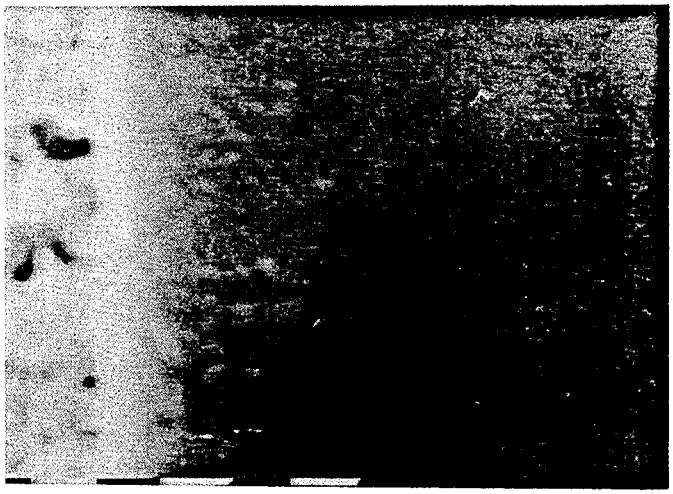
FIG.36.
FIG.37.
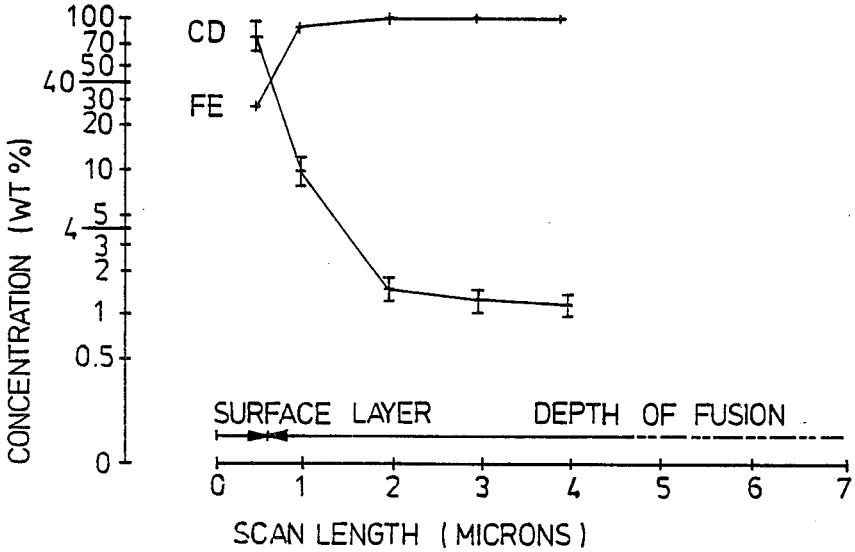

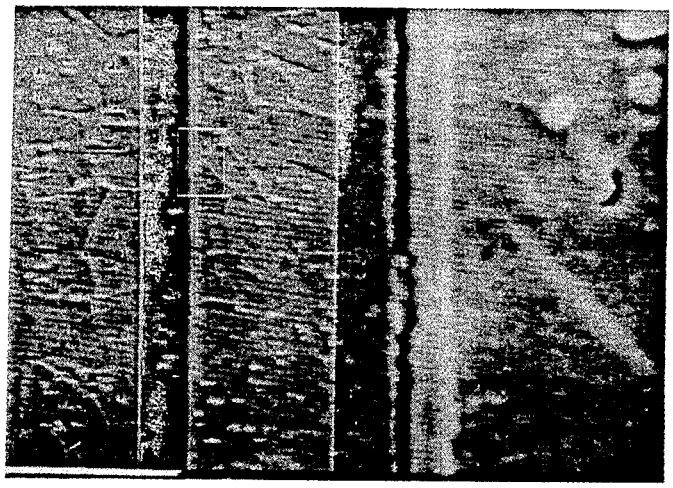
FIG.38.
FIG.39.
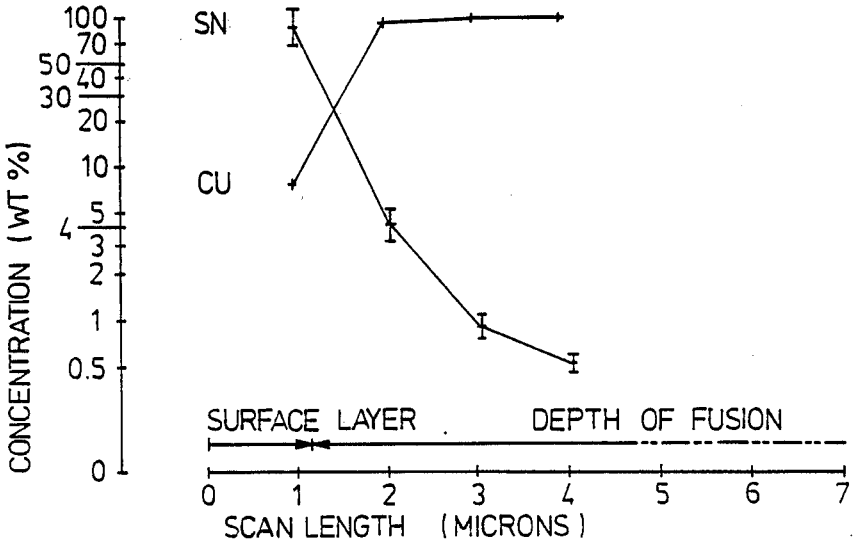

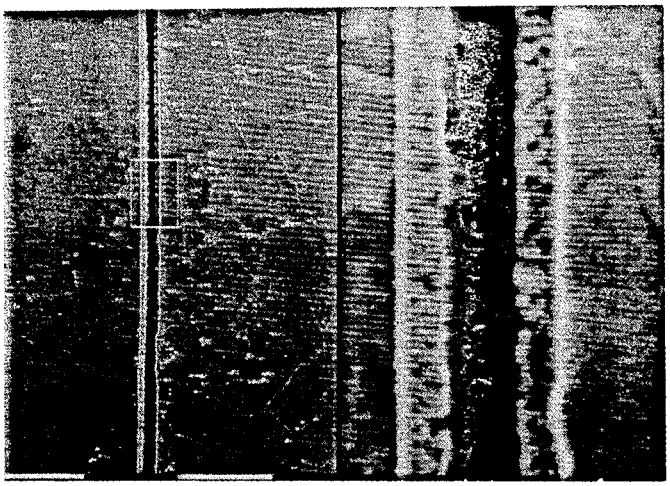
FIG.40.
FIG.41.
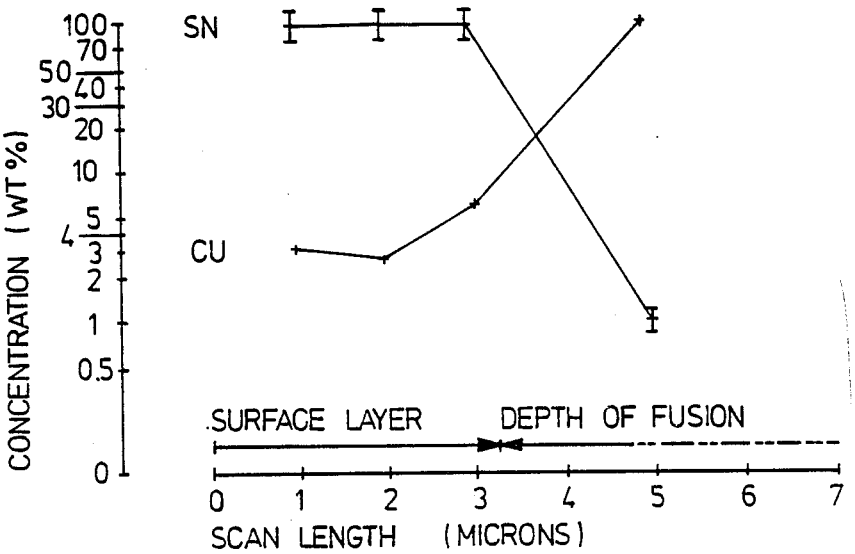

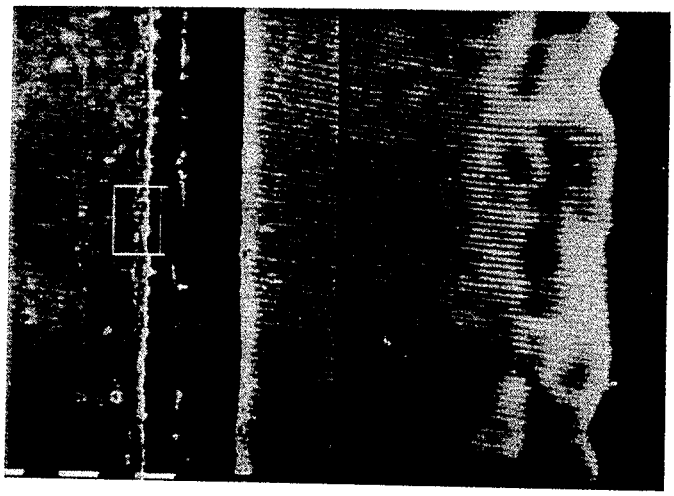
FIG. 42.
FIG. 43.
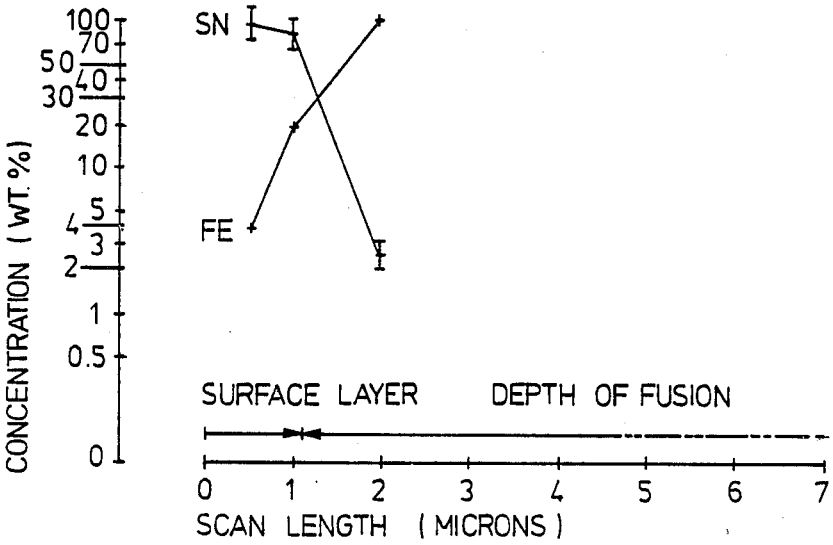

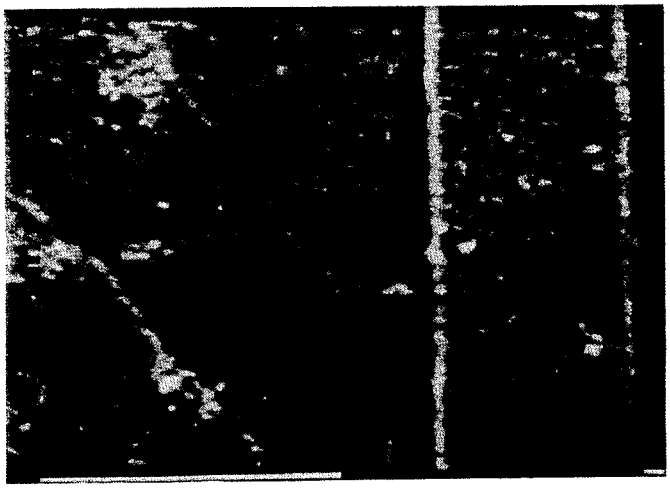
FIG. 44.
FIG. 45.
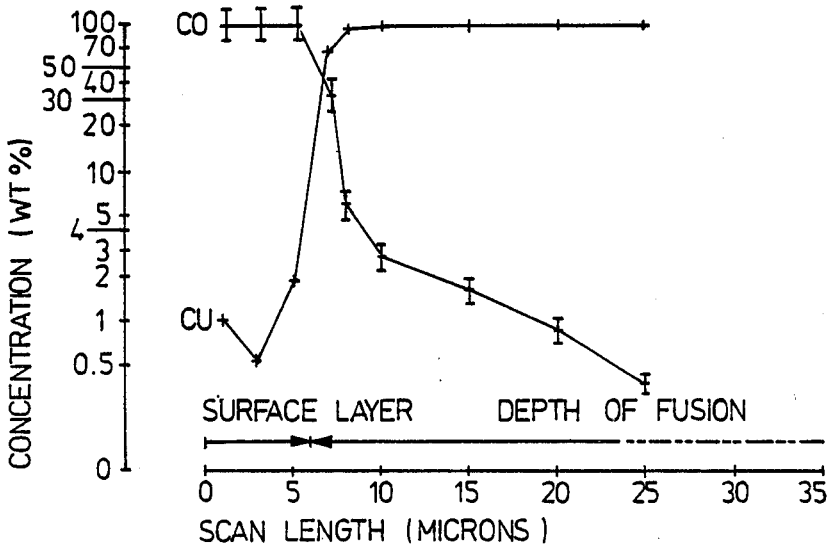

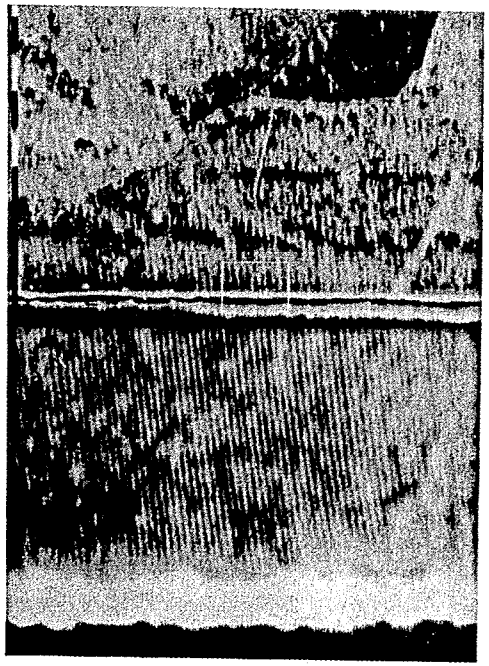
FIG. 46.
FIG 46A
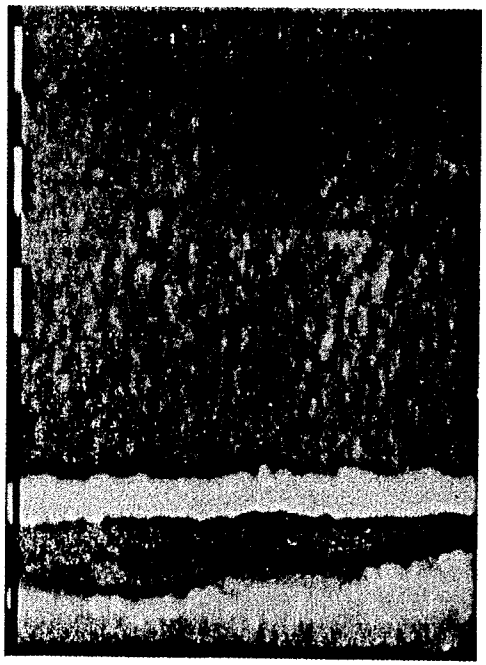

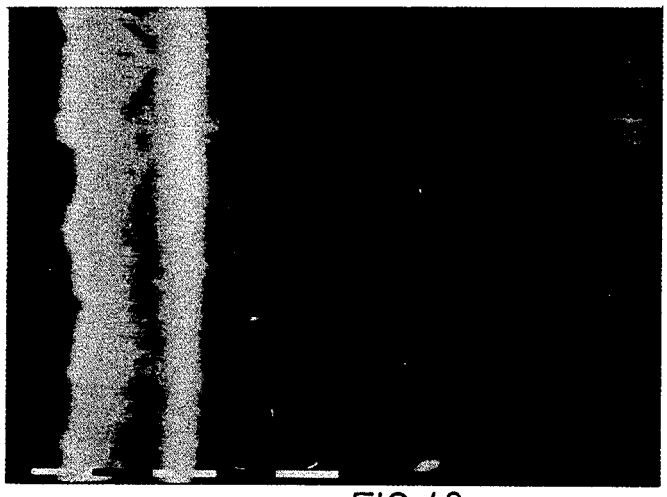
FIG. 48.
FIG. 49.
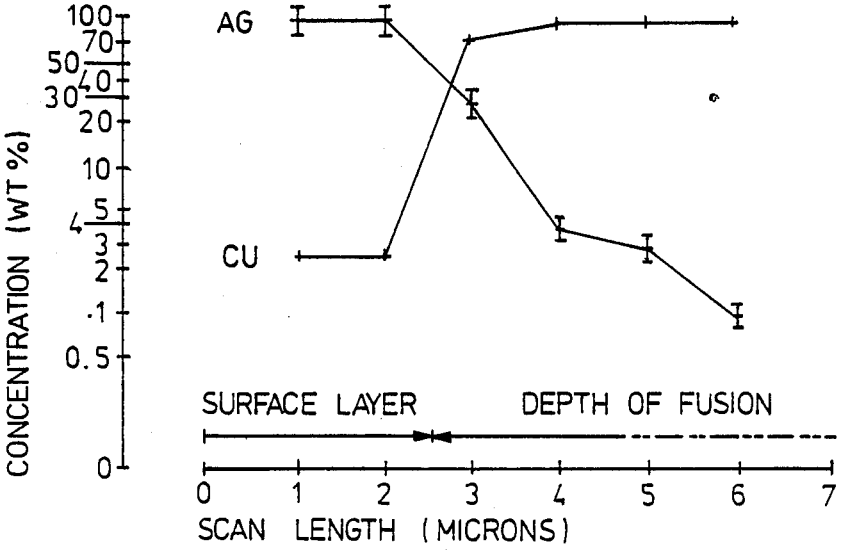

SOLUTIONS FOR THE FUSION OF ONE METAL TO ANOTHER

The present invention is concerned with certain novel solutions which are particularly useful for bonding one material to another, notably one metal to another, according to the process described and claimed in U.S. application Ser. No. 224,762, filed Jan. 13, 1981 and U.S. application Ser. No. 319,672 filed Nov. 9, 1981, both now abandoned.

A process is described and claimed in Ser. No. 319,672 which involves fusing into or onto a first metal or other electrically conductive material, a second metal or electrically conductive material by the steps of:

placing the second conductive material in contact with an adjacent surface of the first conductive material, the second conductive material being in the form of a dissociable solution; and applying an interrupted electrical signal of a predetermined frequency to the first and second materials, whereby the second material is fused to the first material.

According to said process, the solution of the second material may be aqueous or organic. Desirably an aqueous solution is used which has a pH of 0.4 to 14, the amount of second material therein is in the range of 0.10 to 10% by weight of the solution and the resistivity of the solution is in the range of 10 to 80 ohms cm.

Preferably both the first and second materials are metal. For example, the first material may be iron or iron alloy and the second material may be molybdenum, tungsten or indium. A wide variety of ferrous and/or non-ferrous combinations are contemplated.

As indicated, the process of Ser. No .319,672, as well as an embodiment of that process shown in Ser. No. 224,762 contemplate the use of a solution containing the metal to be fused (hereinafter the "second metal") to another metal (hereinafter the "first" metal), it being understood that the term "metal" is intended to embrace metal alloys as well as single metals.

It is to be noted that Ser. No. 224,762 and another U.S. application Ser. No. 319,678 also disclose another process for fusing metals together wherein both metal components are in solid form. This other process may be called "solid-to-solid" fusion for convenience. The present invention, however, is only concerned with the solutions for use in the alternative process wherein one of the metals to be fused is initially in solution form. This is called for convenience "liquid-to-solid" fusion.

Certain of the metal solutions disclosed in Ser. No. 319,672 and others described herein are new and constitute the basis for the present invention. Broadly described, these solutions are aqueous, have a pH of about 0.4–14, a resistivity of 10 to 80 ohms cm and contain:

(1) a compound of a dissociable polyvalent metal to be fused to the other metal;

(2) a compound which is capable of complexing with compound (1), compounds (1) and (2) being either soluble in water or forming a complex which is soluble in water;

(3) a stabilizer which functions to keep (1) and (2) and the complex thereof in solution; and (4) a catalyzer which functions to promote the speed of reaction and reduce the valency of the polyvalent metal to a lower valence and to catalyze the complexing action between (1) and (2). Acid and/or alkaline material may also be used to insure the appropriate pH for the conditions of use and to help keep the metal compounds (1) and (2) in solution.

Certain of these solutions may include a sufficient quantity of an organic solvent to ensure dissolution of the metal and/or the complex.

Certain other solutions may require conductivity enhancing agents. And depending upon the end result desired, brightening agents may also be present. Wetting agents or surfactants may also be provided.

By the use of these solutions it has been found possible to effect fusion of the dissolved metal, using the process described in copending U.S. application Ser. No. 319,672, with a first metal with facility, economy and at ambient temperatures without the attendant physical or chemical changes which usually occur with the usual fusion methods.

These and other objects and features of the present invention will be more apparent from the following description and drawings in which certain specific embodiments of these solutions are illustrative of the invention and in which:

FIG. 3 is a schematic electrical circuit employed in the present invention;

FIG. 4 is a circuit diagram of an oscillator as employed in accordance with one embodiment of the present invention;

FIG. 5 is a composite SEM photomicrograph with right-hand and left-hand valves, of a copper matrix with which molybdenum has been fused using the process of the present invention with a molybdenum solution. The left-hand half has a magnification x1250 and the right-hand half is a x8 enlargement of the marked area of the left-hand half;

FIG. 6 is a graph of an SEM/EPMA scan across the sample shown in FIG. 5 and shows the fusion of molybdenum with copper;

FIG. 7 is a composite SEM photomicrograph, with right and left hand valves, of a steel matrix with which molybdenum has been fused using the process of the present invention with a molybdenum solution. The left hand half has a magnification x1250 and the right hand half is a x8 enlargement of the marked area of the left hand half;

FIG. 8 is a graph of an SEM/EPMA scan across the sample shown in FIG. 7 and shows the fusion of molybdenum with steel;

FIG. 9 is a composite photomicrograph, with right and left hand valves, of a copper matrix with which tungsten has been fused using the process of the present invention with a tungsten solution. The left hand half has a magnification x1250 and the right hand half is a x8 enlargement of the marked area of the left hand half;

FIG. 10 is a further SEM photomicrograph of the sample of FIG. 9 with a magnification x10,000 of part of the marked area of FIG. 9;

FIG. 12 is a composite photomicrograph, with right and left hand halves, of a steel matrix with which tungsten has been fused using the process of the present invention with a tungsten solution. The left hand half has a magnification x1310 and the right hand half is a x8 enlargement of the marked area of the left hand half;

FIG. 13 is a graph of an SEM/EPMA scan across the sample shown in FIG. 12 and shows the fusion of tungsten with steel;

FIG. 14 is a composite photomicrograph with right and left hand halves, of a copper matrix with which indium has been fused using the process of the present invention with an indium solution. The left hand half has a magnification x1250 and the right hand half is a x8 enlargement of the marked section of the left hand half;

FIG. 15 is a graph of an electron microprobe scan across the sample shown in FIG. 14;

FIG. 16 is a composite SEM photomicrograph, with right and left hand halves of a steel matrix with which indium has been fused using the process of the present invention with an indium solution. The left hand half has a magnification x625 and the right hand half is a x8 enlargement of the marked section of the left hand half;

FIG. 17 is a graph of an SEM/EPMA scan across the sample shown in FIG. 16;

FIG. 18 is a composite SEM photomicrograph, with right and left hand halves, of a copper matrix with which nickel has been fused using the process of the present invention with a nickel solution. The left hand half has a magnification x1250 and the right hand half is a x8 enlargement of the marked section of the left hand half;

FIG. 19 is a graph of an SEM/EPMA scan across the sample shown in FIG. 18;

FIG. 20 is a composite SEM photomicrograph with right and left hand halves, of a steel matrix with which nickel has been fused using the process of the present invention with a nickel solution. The left hand half has a magnification x1310 and the right hand half is a x8 enlargement of the marked section of the left hand half;

FIG. 21 is a graph of an SEM/EPMA scan across the sample shown in FIG. 20;

FIG. 22 is a composite photomicrograph of a copper matrix with which gold has been fused. The left hand half has a magnification x1310 and the right hand half is a x8 enlargment of the marked section fo the right hand half.

FIG. 23 is a graph of an SEM/EPMA scan across the sample shown in FIG. 22 showing gold fused in the copper matrix;

FIG. 24 is a composite photomicrograph with right and left hand halves, of a steel matrix with which gold has been fused using the process of the present invention with a gold solution. The left hand half has a magnification x1310, the right hand half is x8 magnification enlargement of the marked area of the left hand half;

FIG. 25 is a graph of an SEM/EPMA scan across the sample shown in FIG. 23 showing gold fused in the steel matrix;

FIG. 26 is an SEM photomicrograph with a magnification x10,000 of a copper matrix with which chromium has been fused using the process of the present invention with a first chromium solution;

FIG. 27 is a graph of an SEM/EPMA scan across the sample shown in FIG. 26 and shows the fusion of chromium with copper;

FIG. 28 is an SEM photomicrograph with a magnification x10,000 of a steel matrix with which chromium has been fused using the process of the present invention with the first chromium solution referred to above;

FIG. 29 is a graph of an SEM/EPMA scan across the sample shown in FIG. 28 and shows the fusion of chromium with steel;

FIG. 30 is a composite SEM photomicrograph, with right and left hand halves, of a copper matrix with which chromium has been fused using the process of the present invention with a second chromium solution. The left hand half has a magnification x625 and the right hand half is a x8 enlargement of the marked area of the left hand half;

FIG. 32 is a graph of an SEM/EPMA scan across the sample shown in FIG. 31 and shows the fusion of chromium with copper;

FIG. 33A is a further enlarged SEM photomicrograph of the enlarged area of FIG. 33 at a magnification of x10,000;

FIG. 34 is a graph of an SEM/EPMA scan across the sample shown in FIG. 32 and shows the fusion of chromium with steel;

FIG. 35 is a composite photomicrograph with right and left hand halves, of a copper matrix with which cadmium has been fused using the process of the present invention with a first cadmium solution; the left hand half has a magnification x1310 and the right hand half is a x5 enlargement of the marked area;

FIG. 36 is a graph of an SEM/EPMA scan across the sample shown in FIG. 35 and shows the fusion of cadmium with copper;

FIG. 37 is a photomicrograph at x11,500 magnification of a steel matrix with which cadmium has been fused using the process of the present invention with a second cadmium solution;

FIG. 38 is a graph of an SEM/EPMA scan across the sample shown in FIG. 37 and shows the fusion of cadmium with steel;

FIG. 39 is a composite photomicrograph with left and right hand halves, of a copper matrix with which tin has been fused using the process of the present invention with a first tin solution; the left hand half has a magnification of x655 and the right hand half is a x8 enlargement of the marked area;

FIG. 40 is an SEM/EPMA scan across the sample of FIG. 39 and shows the fusion of tin with copper;

FIG. 41 is a composite photomicrograph with left and right hand halves, of a copper matrix with which tin has been fused using the process of the present invention with a second tin solution; the left hand half has a magnification x326 and the right hand half is x8 enlargement of the marked area;

FIG. 42 is an SEM/EPMA scan across the sample of FIG. 41 and shows fusion of tin with copper;

FIG. 43 is a composite SEM photomicrograph with right and left hand halves, of a steel matrix with which tin has been fused using the process of the present invention with the second tin solution; the right hand half is a x1310 magnification and the left hand half is x8 magnification of the marked area;

FIG. 44 is a SEM/EPMA scan across the sample of FIG. 43 and shows fusion of tin with steel;

FIG. 45 is an SEM photomicrograph at a x5200 magnification of a copper matrix with which cobalt has been fused using the process of the present invention with a first cobalt solution;

FIG. 46 is an SEM/EPMA scan across the sample of FIG. 45 and shows fusion of cobalt with copper;

FIGS. 47 and 47A are photomicrographs of a copper matrix with which silver has been fused using the process of the invention with a first silver solution;

FIG. 47 is a composite with the left hand side having a magnification of x625 and the right hand side being an x8 enlargement of the marked area;

FIG. 47A is a further enlarged SEM photomicrograph of the enlarged area of FIG. 47 at a magnification x10,000;

FIG. 48 is an SEM/EPMA scan across the sample of FIG. 47 and shows fusion of silver with copper;

FIG. 49 is an SEM photomicrograph at a magnification of x10,000 of a copper matrix with which silver has been fused using the process of the present invention with a second silver solution;

FIG. 50 is an electron microprobe scan across the sample of FIG. 49 and shows fusion of silver with copper.

In those Figures which are graphs, of FIGS. 5 through 50, the vertical axis is logarithmic while the horizontal axis is linear. And in these graphs the surface layer has been taken as the point at which the concentration (wt.%) of the matrix and the element which has been fused therewith are both at 50% as indicated by the projections.

Figure 1:
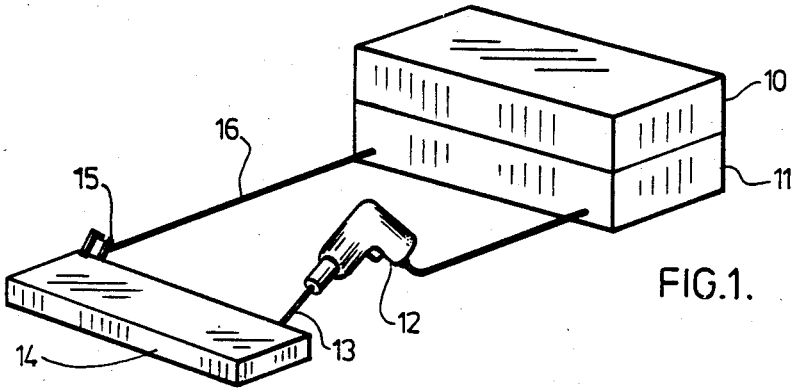
FIG. 1 is a general perspective view of one embodiment of the apparatus in association with which the solutions of the present invention are used.
Figure 2:
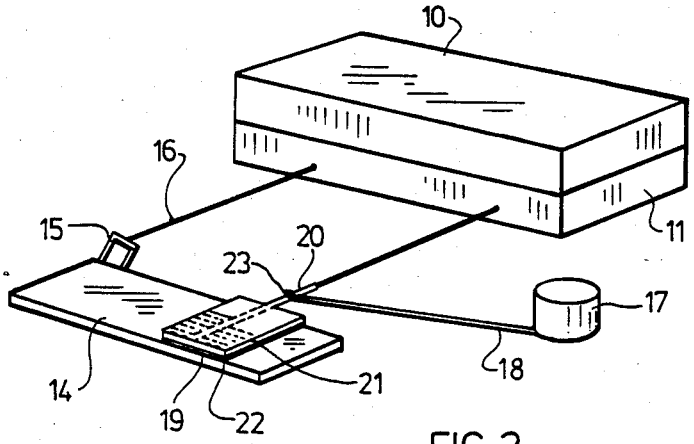
FIG. 2 is a general perspective view of a second embodiment of an apparatus in accordance with the solutions in accordance with the invention may be employed.
Figure 11:
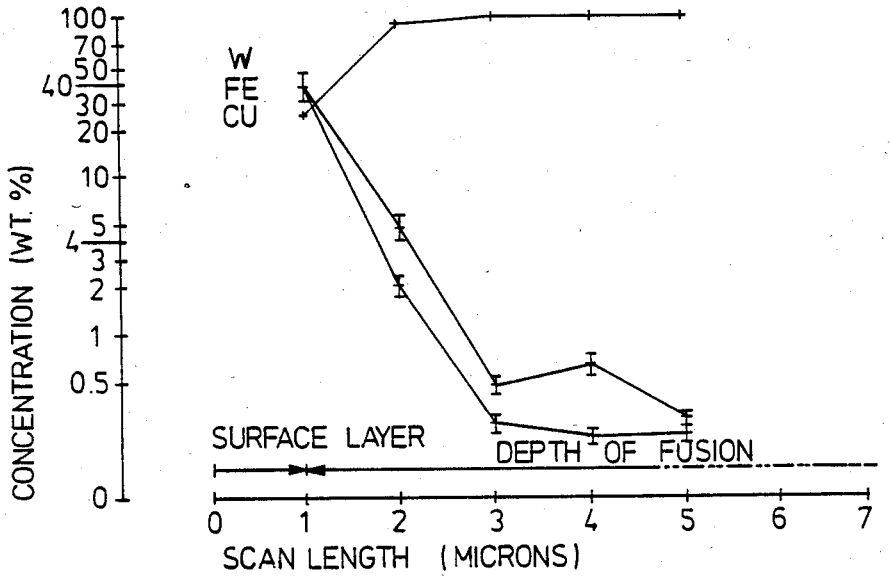
FIG. 11 is a graph of an SEM/EPMA scan across the sample shown in FIGS. 9 and 10.
Figure 31:
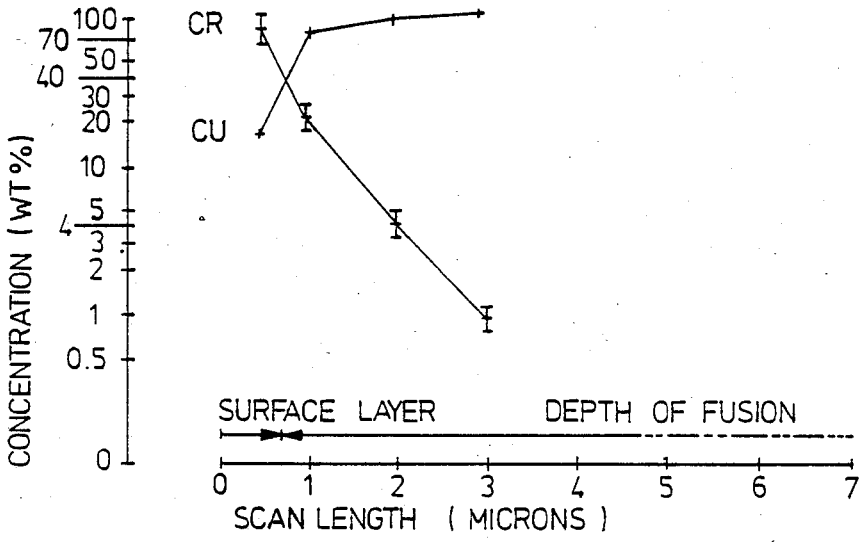
FIG. 31A is a further enlarged SEM photomicrograph of the enlarged area of FIG. 31 at a magnification of x10,000.

Referring now to drawings FIGS. 1 and 2 these drawings illustrate in general perspective view apparatus in accordance with the invention which is employed to carry out the process of the invention.

In FIG. 1, which exemplifies a solid-to-solid process the number 10 indicates a power supply and 11 an oscillator.

One side of the oscillator output is connected to an electrode 13 through a holder 12. Holder 12 is provided with a rotating chuck and has a trigger switch which controls the speed of rotation of the electrode 13. The speed of rotation is variable from 5,000 to 10,000 rpm.

The electrode 13 is composed of the material to be fused with the matrix. The matrix or substrate which is to be subjected to the process and which is to be treated is indicated at 14. The matrix is also connected to the other side of the oscillator output by a clamp 15 and line 16.

By these connections the electrode is positively charged and the matrix is negatively charged when the signal is applied.

In FIG. 2 the corresponding components are correspondingly numbered. However, in this embodiment the process employed may be characterized as a liquid to solid process. In this apparatus the material to be fused is in the form of a solution and is held in a reservoir 17. Reservoir 17 is connected by a tube 18 to an electrode 19. Electrode 19 is a plate provided with an insulated handle 20 through which one side of oscillator 11 output is connected. This output is led into a main channel 21 in electrode 19. Channel 21 has a series of side channels 22 which open on to the undersurface of electrode 20. The flow from reservoir 17 is by gravity or by a pump and may be controlled by a valve such as 23 on the handle 20. For further control, more even distribution of the solution, and to prevent the inclusion of foreign matter the surface of electrode 19 is preferably covered by a permeable membrane such as cotton or nylon.

It has been found that to effect fusion that the application of 50,000 watts/sq. cm. or alternatively the application of current of the order of 10,000 amps/sq. cm. is necessary.

From a practical standpoint 10,000 amps/sq.cm. can not be applied constantly without damage to the matrix to be treated.

However, it has been found practical to apply a pulsing signal of 2.5 microseconds to 28.6 nanoseconds having a magnitude of 3 amps to the electrode and this causes fusion to occur over an area of approximately 0.3 sq. mm.

To effect fusion over an area with the apparatus shown in FIG. 1 the electrode 13, matrix 14 and the oscillator output are connected as shown.

The operator passes the rotating electrode 13 in contact with the upper surface of the matrix over the matrix surface at a predetermined speed to apply the electrode material to the matrix and fuse it therewith.

It has also been found that the continuous application of an alternating signal generates considerable heat in the substrate or matrix and to overcome this heat build-up and avoid weldments the signal generated in the present apparatus is a half-wave signal which permits dissipation of the heat.

As will be apparent to those skilled in the art each material, both the matrix and the material to be applied have specific resistance characteristics. Thus with each change in either one or both of these materials there is a change in the resistivity of the circuit.

In FIG. 3, $R_1$ = the resistance of the electrode, $R_2$ = the resistance of the matrix, and $R_3$ = the resistance of the circuit of 10 and 11.

Variations in $R_1$ and $R_2$ will lead to variations in the frequency of the signal generated and the amplitude of that signal.

As mentioned previously a signal having an amplitude of 3 amps is believed to be the preferred amplitude. If the amplitude is greater decarbonizing or burning of the matrix takes place and below this amplitude hydroxides are formed in the interface.

FIG. 4 is a schematic diagram of an oscillator circuit used in apparatus with the present invention.

In that circuit a power supply 30 is connected across the input, and across the input a capacitor 31 is connected. One side of the capacitor 31 is connected through the LC circuit 32 which comprises a variable inductance coil 33 and capacitor 34 connected in parallel.

LC circuit 32 is connected to one side of a crystal oscillator circuit comprising crystal 35, inductance 36, NPN transistor 37 and the RC circuit comprised of variable resistance 38 and capacitance 39.

This oscillator circuit is connected to output 50 through, on one side capacitor 40, and on the other side diode 41, to produce a halfway signal across output 50.

In the apparatus actually used the several components had the following characteristics:

31 = 1.2 μfarad

32 = 0.3 picrofarad

33 = 0–25 millihenrys

35 = 400 – 30 Khz

36 = 20 millihenrys

37=NPN
38=3.5 μfarads
39=0–500 ohms
40=400 μfarads
41=diode

To maintain the amplitude of the signal at 3 amps $R_1$ resistance 38 is varied; to vary the frequency inductance 33 is varied.

If C=the capacitance of the circuit of FIG. 3 and $R_1$, $R_2$ and $R_3$ are the resistances previously characterized it is believed that the optimum frequency of the fusing signal $F_o$ may be determined by the form $$F_o = \frac{1}{2\pi\sqrt{LC}} \qquad \text{FORM I}$$

where

L=$R_1.R_2.R_3$ and

C=capacitance of the circuit L and C may be determined by any well-known method.

$F_o$ depends on the material being treated and the material being applied but it is in the range 400 Hz-35 MHz. The frequency, it is believed, will determine the speed of the process.

To fuse a predetermined area, the area is measured. Since each discharge will fuse approximately 0.3 sq. mm. then the travel speed may be determined by the following form:

$$\text{Travel speed} = \frac{F_1 \times .3 \times 60/\text{mm/minute}}{A} \qquad \text{FORM II}$$

$$\frac{F_1 = F_o}{2}, \text{ and}$$

A=area to be covered in sq. mm.

$F_1$ is the number of discharges per second.

As mentioned previously the resistances $R_1$ and $R_2$ may be measured by any known means.

However it has been discovered that the measurement of resistance in the liquid phase may not be stable. In this situation the resistance is measured in a standard fashion. Two electrodes, 1 cm. apart and 1 cm. sq. in area are placed in a bath of the liquid phase and the resistance was measured after a 20 second delay. After the variable parameters have been determined and the apparatus, matrix and probe have been connected as shown in FIGS. 1 and 3, the probe 13 is passed over the surface of the matrix in contact therewith at the predetermined speed.

The speed of rotation is also believed to affect the quality of the fusion with a rotation speed of 5,000 rpm the finish is an uneven 200 to 300 finish; with a speed of rotation of 10,000 rpm the finish is a substantially 15 finish.

The apparatus of FIG. 2 is operated in the same manner as the apparatus of FIG. 1 and the process is essentially the same except for the use of a liquid with a solid electrode.

In the following specific examples the use of the solutions in association with the apparatus and in the process will be more clearly understood.

In each of these examples the electrode was so connected as will be apparent from the description, so that when charged the electrode is positively charged and the matrix is negatively charged.

With respect to the fusion of a second conductive chemical element into the solid matrix of a first conductive chemical element, using a solution of the second conductive chemical, with respect to each solution, the process was carried out at the ambient temperature, 20° C., in the following manner.

The matrix 14 metal was connected into the circuit as previously described. The frequency was determined in accordance with the formula previously set forth and the solution in reservoir 17 applied by movement of the electrode over one surface of the first metal for varying periods of time as determined by Form II. To ensure uniform distribution of the second metal solution over the surface of the first metal the electrode was covered with cotton gauze or nylon. It will be apparent that other materials may be employed. This arrangement also served to limit contamination of the solution when graphite electrodes were employed. They had a tendency to release graphite particles in the course of movement.

The treated samples were then sawn to provide a cross-sectional sample, washed in cold water, subject to ultrasonic cleaning, embedded in plastic and ground and polished to produce a flat surface and an even edge. With other samples with the softer metals where there was a tendency to lose the edge on grinding two cross-sections were secured with the treated surface in face to face abutting relationship, embedded as before and ground and polished.

Following embeddment the sample was etched using Nital for steel, the ferrous substrate, and Ammonium Hydrogen Peroxide on the copper, the non-ferrous substrate.

During the course of some applications it was found that adjustments were sometimes required in either the frequency, or speed of application. These were due to changes in the solution composition or variations in the matrix.

A semiquantitative electron probe microanalysis of fused interfaces were performed using an Energy Dispersive X-Ray Spectroscopy (EDX) and a Scanning Electron Microscope (SEM).

The surface of the embedding plastic was rendered conductive by evaporating on it approximately 20 um layer of carbon in a vacuum evaporator. This procedure was used to prevent buildup of electrical charges on an otherwise nonconductive material and a consequent instability of the SEM image. Carbon, which does not produce a radiation detectable by the EDX, was used in preference of a more conventional metallic coating to avoid interference of such a coating with the elemental analysis.

Operating conditions of the SEM were chosen to minimize extraneous signals and the continuum radiation and to yield at the same time the best possible spatial resolution.

The conditions typically used for the elemental analyses by EDX were as follows:

Accelerating potential—10–20 kV
Final Aperture—200–300
Spot size—50 nm
Beam current—100–300 pA
Working distance—12–34 mm
Magnification factor—5,000–10,000
Specimen angle—normal to the beam
Take-off angle—225°
Count rate—800–2000 cps
Live time—60–180 sec.

Energy calibration was tested using Al kd emission at 1.486 keV and cu K at 8.040 keV.

A standardless semiquantitative analysis was adopted for determination of elemental concentration, using certified reference materials (NBS 478, 78% Cu-27% Zn and NBS 479a, Ni, 11%, Cr 18%, Fe) to verify results. Multiple analysis of reference materials were in excellent agreement with certified values from NBS. Average precision of ±1% was achieved. A size of analysed volume was calculated from the following equation 1:

$$p^R(x)=0.064(E_o^{68}-E_c^{68})$$

where $R_{(x)}$ is the mass range (th x-ray production volume)

p=Density of analysed material $E_o$=The accelerating potential $E_c$=A critical excitation energy.

The diameter of analysed volume was calculated for typical elements analysed and was found to be as follows:

Ni—0.46
Cu—0.39
Fe—0.55
W—0.30

For assessment of the diffusion depth a static beam was positioned across the interface at intervals greater than the above mentioned mass range. Ensuring thus the accuracy of the analysis.

The results of elemental concentration were given in weight percentage (Wt%) for each of the measured points across the fusion interface.

As mentioned previously the metal solutions disclosed in Ser. No. 319,672 are new and constitute the basis for the present invention. Broadly described, these solutions are aqueous, have a pH of about 0.4–14, a resistivity of 10 to 80 ohms cm and contain:

(1) a compound of a dissociable polyvalent metal to be fused to the other metal;

(2) a compound which is capable of complexing with compound (1), compounds (1) and (2) being either soluble in water or forming a complex which is soluble in water;

(3) a stabilizer which functions to keep (1) and (2) and the complex thereof in solution; and (4) a catalyzer which functions to promote the speed of reaction and reduce the valency of the polyvalent metal to a lower valence and to catalyze the complexing action between (1) and (2). Acid and/or alkaline material may also be used to insure the appropriate pH for the conditions of use and to help keep the metal compounds (1) and (2) in solution.

Certain of these solutions may include a sufficient quantity of an organic solvent to ensure dissolution of the metal and/or the complex.

Certain other solutions may require conductivity enhancing agents. And depending upon the end result desired, brightening agents may also be present. Wetting agents or surfactants may also be provided.

A variety of dissociable polyvalent metal compounds, usually metallic salts or acids, may be used as component (1) provided they are soluble in the solution medium. Typical compounds include: sodium molybdate, sodium tungstate, indium sulphate, nickelous sulphate, nickelous chloride, chloroauric acid, chromium trioxide, chromium sulphate, chromic chloride, cadmium chloride, cadmium sulphate, stannous chloride, cobaltous sulphate, silver cyanide, silver nitrate.

Normally component (1) will be used in an amount varying from 0.10 to 10% by weight based on the total weight of the solution. However, it will be appreciated that other amounts may be used, the particular amount used in any given situation depending on other conditions of use.

Representative metal complexing agents useful as component (2) include, such as, pyrophosphates, ethylene diamine tetracetic acid, citric acid, and potassium iodide and the like. The pyrophosphates also serve as stabilizing agents.

This component will usually consist of from 3 to 10% of the weight of solution. However, the amount can be varied and should be selected to give optimum complexing with (1).

A wide variety of stabilizers and catalysts may be used as components (3) and (4), respectively. Typical stabilizers are the following: boric acid, citric acid or citrates, pyrophosphates, acetates and aluminum sulphate; while suitable catalysts include: metallic ions such as iron, nickel, anitmony, and zinc, and organic compounds such as dextrine, hydroquinone, gelatin, pepsin and acacia gum.

The amounts of these to components can be varied but usually each will fall in the range of 0.01 to 0.5% by weight of the solution.

A wide variety of materials may be used to provide for the desired pH. Typical acids, and bases include the following:

Acids: sulphuric, hydrochloric, hydrofluoric, orthophosphoric, citric and oxalic.

Bases: ammonium hydroxide, sodium hydroxide, potassium hydroxide and basic salts such as alkali carbonates and bicarbonates.

Typical brighteners are formaldehyde and carbon disulphide. A surfactant or wetting agent which is employed in some solutions is sodium lauryl sulphate. Others familiar to those in the art may be substituted.

In some solutions a cnoductivity enhancing agent such as sodium sulphate may be employed.

It will be noted that in Examples II, III and IV which follow, ferrous and ferric ions are provided in the solution. While the iron was apparently transferred concurrently with molybdenum to the matrix there was no apparent material effect on the matrix or molybdenum which was fused with it.

It has been found that the transfer of molybdenum into the matrix was enhanced by the presence of the ferric and ferrous ions. The exact nature of the mechanism is not known but it is believed that the presence of these iron ions forms complexes which enhances the reduction of $Mo^{+6}$ to lower valency states.

Certain further solutions require second chemical conductive element complexing agents which preclude precipitation of the second element. These agents were by way of example citric acid, or sodium pyrophospate, or ethyldiaminetetracetic acid or their equivalents.

A suitable buffer is also provided in certain solutions, where required.

The water is always demineralized.

And for certain applications where the appearance of the product requires an elegant appearance small quantities of brighteners such as formaldehyde, carbon disulphide, benzene, sulphonic acid or their equivalents may be employed.

In these Examples, unless otherwise indicated the steel matrix was ASA 1018 and the copper was ASTM B-1333 Alloy 110.

EXAMPLE I

Atlas A151 1020 steel was connected in the apparatus of FIG. 2 as the matrix 14 and a 10% solution of ammonium molybdate in water was placed in reservoir 17.

The following were the characteristics and conditions of treatment:

Matrix Resistance—0.0018 ohms
*Probe Resistance—150 kiloohms
Circuit Resistance—0.01 ohms
Frequency—650 Hz at 0.4 picrofarad
Contact Area—2 sq. cm.
Speed—60 cm./minute
Depth of Treatment—0.5 μm
Surface Buildup—15 μm

*Determined by measurement across 1 sq. cm. plates spaced apart 1 cm. after a 20 second delay.

The sample of Example I was subject to a thermal corrosion test. 25% sulphuric acid was applied to the surface for 20 minutes at 325° C. without any surface penetration.

EXAMPLE II

An aqueous solution of the following formulation was prepared:

| NAME | GRAM/LITER |
|---|---|
| Sodium Molybdate | 37.8 |
| Ferrous Ammonium Sulphate | 7 |
| Ferric Ammonium Sulphate | 8.6 |
| Citric Acid | 66.0 |
| Water (distilled) | 997 ml. |
| Sodium Lauryl Sulphate | 0.5 |
| Ammonium Hydroxide | to required pH |
| Acacia (gum arabic) | 0.1–0.2 |
| Formaldehyde | 7.5 ml. |

The solution had the following characteristics:

pH=7.5
Resistivity=19 ohms cm
$Mo^{+6}$ concentration=1.8% by wt.
$Fe^{+2}$=0.10% by wt.
$Fe^{+3}$=0.10% by wt.

The $Mo^{+6}$ concentration may be varied from 1.5% to 2.5% by weight; the pH from 7.2 to 8.2 and the resistivity from 17–25 ohms cm.

REACTION CONDITIONS

Matrix: Copper
Electrode: Graphite
Electrode Cover: Woven cotton
Frequency: 9.09 KHz
Rate of Application: 736.2 mm/minute
Time of Application: 2 minutes In the solutions set out in Examples II and III the presence of the ferrous and ferric ions are believed to serve to reduce the $Mo^{+6}$ valency state to a lower valency state.

While iron is apparently concurrently transferred as illustrated in FIG. 6 the iron has apparently no material effect on the characteristics of the matrix or the molybdenum.

An examination of the sample with an optical microscope shows a continuous coating of molybdenum free from pitting and with a dark silver colour.

As shown in the table below and FIG. 6 an SEM-/EPMA scan across the interface between the matrix and the applied metal, molybdenum is seen to be fused to a depth of at least 4 um with a surface deposit of approximately 1 um.

TABLE

| DEPTH μm | ELEMENT | CONCENTRATION (WT %) |
|---|---|---|
| 0.5 | Mo | 65.4 |
| | Fe | 19.9 |
| | Cu | 14.5 |
| 1.0 | Mo | 58.4 |
| | Fe | 10.9 |
| | Cu | 30.5 |
| 2.0 | Mo | 6.6 |
| | Fe | 0.8 |
| | Cu | 92.5 |
| 3.0 | Mo | 2.9 |
| | Fe | 0.4 |
| | Cu | 96.6 |
| 4.0 | Mo | 0.9 |
| | Fe | 0.0 |
| | Cu | 98.9 |

EXAMPLE III

An aqueous solution of the same formulation as Example II was prepared and applied under the following conditions:

Reaction Conditions

Matrix=Steel (ASA 1018)
Electrode=Graphite
Electrode Cover=Woven cotton
Frequency=4.11 KHz Rate of Application=739.8 mm/minute
Time of Application=3 minutes Examination under the optical microscope showed a continuous dark silver surface.

The photomicrograph FIG. 7, shows the deposition of a substantially uniform layer of molybdenum 1 micron thick of uniform density.

As shown in FIG. 8 an SEM/EPMA scan across the interface between the substrate and the applied metal shows molybdenum was present to a depth of at least 10 microns and a molybdenum gradient as set out below in Table.

TABLE

| DEPTH μm | ELEMENT | CONCENTRATION (WT %) |
|---|---|---|
| 0.5 | Mo | 81.0 |
| | Fe | 19.0 |
| 2 | Mo | 2.2 |
| | Fe | 97.8 |
| 3 | Mo | 0.8 |
| | Fe | 99.2 |
| 10 | Mo | 0.6 |
| | Fe | 99.4 |

EXAMPLE IV

An aqueous solution of the following formulation was prepared:

| TIME | GRAM/LITER |
|---|---|
| Sodium Tungstate | 31.40 |
| Ferric Ammonium Sulphate | 8.63 |
| Ferrous Sulphate | 4.98 |
| Citric Acid | 66.00 |
| Water (distilled) | 1000 ml |
| Ammonium Hydroxide | to required pH |
| Sodium Lauryl Sulphate | 0.1 |

-continued

| TIME | GRAM/LITER |
|---|---|
| Formaldehyde | 5 ml |

The solution had the following characteristics:

pH=7.99
Resistivity=22 ohms cm
$W^{+6}$=1.75% by wt.
$Fe^{+2}$=0.1% by wt.
$Fe^{+3}$=0.1% by wt.

The $W^{+6}$ concentration may vary from 1.6% to 2.5%; the pH may vary from 7.5 to 8.5; and the resistivity may vary from 18 ohms cm to 24 ohms cm.

Reaction Conditions

Matrix=Copper
Electrode=Graphite
Cover=Cotton gauze
Frequency=3.83 KHz
Rate of Application=689.4 mm/minute
Time of Application=3 minutes As shown by the photomicrographs FIGS. 9 and 10, the sample showed a uniform deposit of tungsten approximately 1 micron thick. An SEM/EPMA scan showed fusion of tungsten on copper to a depth of at least 5.0 microns, as can be seen in the Table below and FIG. 11.

TABLE

| DEPTH μm | CONCENTRATIONS (WT %) | | |
|---|---|---|---|
| 1.0 | 37.3 | 38.5 | 24.2 |
| 2.0 | 4.8 | 2.1 | 93.1 |
| 3.0 | 0.5 | 0.3 | 99.2 |
| 4.0 | 0.7 | 0.2 | 99.1 |
| 5.0 | 0.3 | 0.2 | 99.5 |

EXAMPLE V

An aqueous solution of the following formulation was prepared:

| NAME | GRAMS/LITER |
|---|---|
| Sodium Tungstate | 34.00 |
| Ferrous Sulphate[1] | 4.98 |
| Ferrous Ammonium Sulphate[2] | 7.02 |
| Ferric Ammonium Sulphate | 8.62 |
| Citric Acid | 66.00 |
| Water (Distilled) | 980 |
| Ammonium Hydroxide | to required pH |
| Sodium Lauryl Sulphate | 0.10 |

NOTE: Either 1 or 2 may be employed

The solution had the following characteristics:

pH=8
Resistivity=20.9 ohms cm.
$W^{+6}$=1.9% by wt.
$Fe^{+2}$=0.1% by wt.
$Fe^{+3}$=0.1% by wt.

The concentration of tungsten may be varied from 1.6% to 2.5% by wt.; the pH from 7.5 to 8.5; and the conductivity from 18.8 ohms cm to 22.8 ohms cm.

Reaction Conditions

Matrix=Steel (ASA 1018)
Electrode=Graphite
Electrode Cover=Cotton gauze
Frequency=4.78
Rate of Application=860.4 mm/minute
Time of Application=3 minutes An inspection of the sample by SEM/EPMA, FIG. 12, showed a deposit of tungsten of approximately 0.5 um and as evident from FIG. 13 and the Table below tungsten was detected at a depth of at least 3 um.

TABLE

| DEPTH μm | ELEMENT | CONCENTRATION (WT %) |
|---|---|---|
| 0.5 | W | 52 |
| 1 | W | 6 |
| 2 | W | 1 |
| 3 | E | 1.1 |

EXAMPLE VI

An aqueous solution of the following formulation was prepared:

| NAME | GRAM/LITER |
|---|---|
| Indium Sulphate | 40.0 |
| Aluminium Sulphate | 9.6 |
| Sodium Sulphate | 3.5 |
| Gelatin | 0.05–0.1 |
| Sodium Lauryl Sulphate | 0.1–0.2 |
| Water (distilled) | 1000 ml. |

The solution had the following characteristics:

pH=1.60
Resistivity=51.8 ohms cm.
Concentration $In^{+3}$=1.75% by wt.
Concentration $Al^{+3}$=0.077 by wt.

The Indium concentration may vary from 0.2% to 2.2%; the pH from 1.60 to 1.68; and the resistivity from 48.8 ohms cm to 54.8 ohms cm.

Reaction Conditions

Matrix=Copper
Electrode=Graphite
Electrode Cover=Cotton gauze
Frequency=4.75
Rate of Application=855 mm/minute
Time of Application=3 minutes An examination of the sample under the optical microscope and the scanning electron microscope showed a continuous surface free from structural faults as shown in FIG. 14.

As shown in the following Table and FIG. 15 and an SEM/EPMA scan across the interface between the copper matrix and the indium layer showed a deposit of approximately 1 um and fushion of indium to a depth of at least 4 um.

TABLE

| DEPTH μm | ELEMENT | CONCENTRATION INDIUM (WT %) |
|---|---|---|
| 1 | In | 90.3 |
| 2 | In | 5.5 |
| 3 | In | 4.3 |
| 4 | In | 3.6 |

EXAMPLE VII

The solution of Example VI was employed and applied to a steel matrix:

Reaction Conditions

Matrix=Steel (ASA 1010)

Electrode=Platinum
Electrode Cover=Woven nylon
Frequency=6.29 KHz
Rate of Application=1132.2 mm/minute
Time of Application=3 minutes As shown in FIGS. 16 and 17 an even continuous layer of Indium approximately 1 um thick was deposited on the surface of the matrix. An SEM/EPMA scan, FIG. 16 across the interface and the Table below indicated fusion to a depth of at least 3 um:

TABLE

| DEPTH μm | In (Wt %) | Fe (Wt %) |
|---|---|---|
| 0.5 | 91.4 | 8.6 |
| 1.0 | 5.2 | 94.8 |
| 2.0 | 1.0 | 99.0 |
| 3.0 | 0.9 | 99.1 |

FIG. 18 shows a solid deposit of nickel of uniform density approximately 1.5 um thick. As shown in the following Table and FIG. 19 an SEM/EPMA scan across the interface between the matrix and the nickel layer shows nickel to be fused to a depth of at least 4 um.

| DEPTH μm | ELEMENT | WT % |
|---|---|---|
| 1 | Ni | 92.6 |
| 2 | Ni | 4.5 |
| 3 | Ni | 3.3 |
| 4 | Ni | 1.0 |

EXAMPLE VIII

An aqueous solution of the following formulation was prepared:

| NAME | GRAM/LITER |
|---|---|
| Nickelous Sulphate | 248.9 |
| Nickelous Chloride | 37.3 |
| Boric Acid | 24.9 |
| Formaldehyde | 3 ml/liter |
| Benzene Sulphonic Acid | 10 ml/liter |
| Sodium Lauryl Sulphate | 0.1 |
| Water (distilled) | 900 |

The solution had the following characteristics:
ph=3.10
Resistivity=22.5 ohms cm.
Concentration of $Ni^{+2}$=6% by wt.
The nickel concentration may vary from 2% to 10%; pH from 3.10 to 3.50; and resistivity from 17 ohms cm to 26 ohms cm.

Reaction Conditions

Matrix=Copper
Electrode=Graphite
Electrode Cover=Cotton gauze
Frequency=7.50 KHz
Rate of Application=1.350 mm/minute
Time of Application=3 minutes

EXAMPLE IX

The same solution as was formulated for Example X was prepared and applied to a steel matrix:

Reaction Conditions

Matrix=Steel ASA (1018)
Electrode=Graphite
Electrode Cover=Cotton gauze
Frequency=7.50 KHz
Rate of Application=1350 mm/minute
Time of Application=3 min.

As shown in FIG. 20 the nickel layer is continuous and substantially uniform in thickness being about 1.5 um thick.

As shown in FIG. 21 and in the following Table nickel is shown to be fused to a depth of at least 3 um.

| DEPTH μm | ELEMENT | CONCENTRATION (Wt %) |
|---|---|---|
| 1 | Ni | 95.9 |
| 2 | Ni | 28.0 |
| 3 | Ni | 0.7 |

EXAMPLE X

An aqueous solution of the following formulation was prepared:

| NAME | GRAMS/LITER |
|---|---|
| Chloroauric acid | 2.5 |
| Potassium ferrocyanide | 15.0 |
| Potassium carbonate | 15.0 |
| Water (distilled) | 1000 ml |

This solution had the following characteristics:
pH=10.99
Resistivity=40 ohms cm.
Concentration of=0.14% by wt.
The pH may be varied from 3.70 to 11; the concentration of $Au^{+3}$ ions may vary from 0.1% to 0.5% by weight; and the resistivity from 40 ohms cm to 72 ohms cm.

REACTION CONDITIONS

MATRIX=Copper
ELECTRODE=Platinum
ELECTRODE COVER=Cotton gauze
FREQUENCY=4.33 KHz
RATE OF APPLICATION=779.4 mm/minute
TIME OF APPLICATION=2 minutes Observation with the optical and scanning electron microscope revealed a surface deposition of gold approximately 1.5 um thick. The deposit was continuous and uniformly dense as shown in FIG. 22.

An SEM/EPMA scan across the interface indicated fusion of gold to a depth of at least 3 um as shown on the Table below and FIG. 23.

| DEPTH (μm) | ELEMENT | CONCENTRATION (Wt %) |
|---|---|---|
| 0.5 | Au | 61.3 |
| 1.0 | Au | 9.6 |
| 2.0 | Au | 0.9 |
| 3.0 | Au | 0.5 |

EXAMPLE XI

An aqueous solution of the same formulation as that of Example X was prepared:

REACTION CONDITIONS

MATRIX=Steel
ELECTRODE=Graphite

ELECTRODE COVER=Cotton gauze
FREQUENCY=3.95 KHz
RATE OF APPLICATION=711.0 mm/minute
TIME OF APPLICATION=2.0 minutes Observation with the optical and scanning electron microscope revealed a surface deposition of gold approximately 1.0 um thick. The deposit was uniformly thick and dense as shown in FIG. 24.

An SEM/EPMA scan across the interface indicated fusion of gold to a depth of at least 4.0 um as shown on the table below and FIG. 25.

| DEPTH μm | ELEMENT | CONCENTRATION (Wt %) |
|---|---|---|
| 0.5 | Au | 84.9 |
| 1.5 | Au | 10.6 |
| 2.0 | Au | 2.1 |
| 3.0 | Au | 0.8 |
| 4.0 | Au | 0.6 |

EXAMPLE XII

An aqueous solution of the following formulation was prepared:

| NAME | GRAMS/LITER |
|---|---|
| Chromium Trioxide | 150 |
| Chromium Sulphate | 0.06 |
| Sulphuric Acid | 2.15 |
| Sodium Silico Fluoride | 0.2 |
| Carbon Disulfide | 2-3 ml |
| Sodium Lauryl Sulphate | 0.05 |
| Water (distilled) to | 1000 ml |

This solution had the following characteristics:
pH=0.6
Resistivity=12 ohms cm
Concentration of $Cr^{+6}$=7.8% by wt.

The pH may be varied from 0.6 to 1.0; the concentration of $Cr^{+6}$ ions may vary from 3% to 20% by weight; and the resistivity from 11 ohms cm to 14 ohms cm.

REACTION CONDITIONS

MATRIX=Copper
ELECTRODE=Graphite
ELECTRODE COVER=Cotton gauze
FREQUENCY=6.25 KHz
RATE OF APPLICATION=1125 mm/minute
TIME OF APPLICATION=5.0 minutes Observation with the optical and scanning electron microscope revealed a surface deposition of chromium approximately 1 um thick. The surface of the layer was irregular but the deposit appeared free of faults and was continuous as shown in FIG. 26.

An SEM/EPMA scan across the interface indicated fusion of chromium to a depth of at least 3.0 um as shown on the table below and FIG. 27.

| DEPTH μm | ELEMENT | CONCENTRATION (Wt %) |
|---|---|---|
| 0.5 | Cr | 94.0 |
| 1.0 | Cr | 32.0 |
| 2.0 | Cr | 1.8 |
| 3.0 | Cr | 1.0 |

EXAMPLE XIII

An aqueous solution of the same formulation as employed in Example XII was prepared:

REACTION CONDITIONS

MATRIX=Steel (ASA 1018)
ELECTRODE=Graphite
ELECTRODE COVER=Cotton gauze
FREQUENCY=6.48 KHz
RATE OF APPLICATION=1166.4 mm/minute
TIME OF APPLICATION=5.0 minutes Observation with the optical and scanning electrode microscope revealed a surface deposition of chromium approximately 3.0 um thick. This is as shown in FIG. 28.

An SEM/EPMA scan across the interface indicated fusion of chromium to a depth of at least 5.0 um as shown on the table below and FIG. 29.

| DEPTH μm | ELEMENT | WT % |
|---|---|---|
| 1.0 | Cr | 100 |
| 2.0 | Cr | 97.2 |
| 3.0 | Cr | 20.8 |
| 4.0 | Cr | 2.8 |
| 5.0 | Cr | 2.1 |

EXAMPLE XIV

An aqueous solution of the following formulation was prepared:

| NAME | GRAMS/LITER |
|---|---|
| Chromic Chloride | 213 |
| Sodium Chloride | 36 |
| Ammonium Chloride | 36 |
| Boric Acid | 20 |
| Dimethyl Formamide | 400 ml |
| Sodium Acetate | 3.0 |
| Sodium Lauryl Sulphate | 0.5 |
| Water (distilled) to | 1000 ml. |

This solution had the following characteristics:
pH=3.0
Resistivity=17.4 ohms cm.
Concentration of $Cr^{+3}$=2.5 to 3.5

The pH may be varied from 2.5 to 3.5; the concentration of $Cr^{+3}$ ions may vary from 1.8% to 5% by weight; and the resistivity from 16 ohms cm to 20 ohms cm.

REACTION CONDITIONS

MATRIX=Copper
ELECTRODE=Graphite
ELECTRODE COVER=Cotton gauze
FREQUENCY=6.85 KHz
RATE OF APPLICATION=1251 mm/minute
TIME OF APPLICATION=3.0 minutes Observation with the optical and scanning electron microscope revealed a surface deposition of chromium approximately 0.5 um thick. The deposit was solid and continuous as shown in FIGS. 30 and 30A.

An SEM/EPMA scan across the interface indicated fushion of chromium to a depth of at least 3.0 um as shown on the Table below and FIG. 32.

| DEPTH μm | ELEMENT | CONCENTRATION (Wt %) |
|---|---|---|
| 1 | Cr | 21.2 |
| 2 | Cr | 4.0 |
| 3 | Cr | 0.9 |

EXAMPLE XV

An aqueous solution of the same formulation as prepared for Example XVII was employed:

REACTION CONDITIONS

Figure 33:
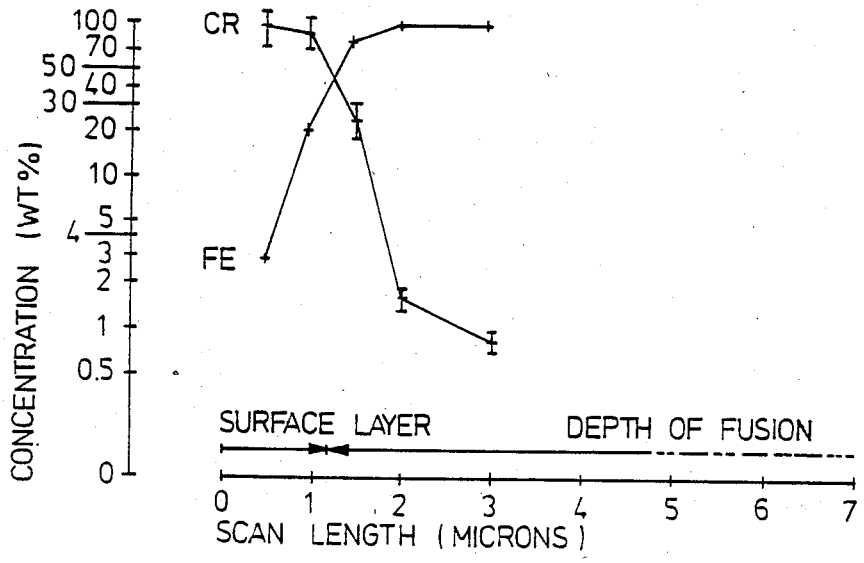
FIG. 33 is a composite SEM photomicrograph, with right and left hand halves, of a steel matrix with which chromium has been fused using the process of the present invention with a second chromium solution. The left hand half has a magnification x1250 and the right hand half is a x8 enlargement of the marked area of the left hand half.

MATRIX=Steel (ASA 1018)
ELECTRODE=Graphite
ELECTRODE COVER=Cotton gauze
FREQUENCY=6.85 KHz
RATE OF APPLICATION=1251 mm/minute
TIME OF APPLICATION=3.0 minutes Observation with the optical and scanning electron microscope revealed a surface deposition of chromium approximately 1.0 um thick. The surface of the deposit appeared slightly irregular but the deposit was solid and free of faults as shown in FIGS. 33 and 33A.

An SEM/EPMA scan across the interface indicated fusion of chromium to a depth of at least 3.0 um as shown on the table below and FIG. 34.

| DEPTH μm | ELEMENT | CONCENTRATION (Wt %) |
|---|---|---|
| 0.5 | Cr | 97.2 |
| 1.0 | Cr | 97.6 |
| 1.5 | Cr | 22.2 |
| 2.0 | Cr | 1.5 |
| 3.0 | Cr | 0.8 |

EXAMPLE XVI

An aqueous solution of the following formulation was prepared:

| NAME | GRAMS/LITER |
|---|---|
| Cadmium Chloride | 6.74 |
| Tetrasodium Pyrophosphate | 54 |
| Water (distilled) | 1000 ml. |

This solution had the following characteristics:
pH=10
Resistivity=33 ohms cm.
Concentration of $Cd^{+2}$=0.32% by wt.

The pH may be varied from 10 to 10.2; the concentration of $Cd^{+2}$ ions may vary from 0.2% to 0.5% by weight; and the resistivity from 28 ohms cm to 35 ohms cm.

REACTION CONDITIONS

MATRIX=Copper
ELECTRODE=Graphite
ELECTRODE COVER=Cotton gauze
FREQUENCY=(1) 7.29 KHz; (2) 7.91 KHz
RATE OF APPLICATION=(1) 1312.2 mm/min; (2) 1423.8 mm/min.
TIME OF APPLICATION=(1) 1.0 min; (2) 3.0 min.

In this Example the solution employed was initially as set out above, applied in accordance with the conditions identified as (1). A second solution, that set forth in Example XVII, was then applied under the conditions identified as (2). Observation with the optical and scanning electron microscope revealed a surface deposition of cadmium approximately 4 um thick. This deposit was not homogeneous as shown in FIG. 35 but an SEM/EPMA scan across the interface indicated fusion of cadmium to a depth of at least 9 um as shown on the Table below and FIG. 36.

| DEPTH μm | ELEMENT | CONCENTRATION (Wt %) |
|---|---|---|
| 2 | Cd | 77.4 |
| 3 | Cd | 65.2 |
| 4 | Cd | 6.7 |
| 5 | Cd | 1.2 |
| 6 | Cd | 0.48 |
| 7 | Cd | 2.1 |
| 8 | Cd | 2.9 |
| 9 | Cd | 0.89 |

EXAMPLE XVII

An aqueous solution of the following formulation was prepared:

| NAME | GRAMS/LITER |
|---|---|
| Cadmium Sulphate | 26.65 |
| Sodium Chloride | 8.7 |
| Boric Acid | 15.0 |
| Aluminium Sulphate | 17.5 |
| Acacia (Gum Arabic) | 0.25 |
| Sodium Tetraborate | 5.0 |
| Benzene Sulphonic Acid | 2.5 |
| Sodium Lauryl Sulphate | 0.5 |
| Water (distilled) | 1000 ml |

This solution had the following characteristics:
pH=3.40
Resistivity=54 ohms cm.
Concentration of $Cd^{+2}$=1.1%

The pH may be varied from 3.2 to 3.5; the concentration of $Cd^{+2}$ ions may vary from 1% to 4% by weight; and the resistivity from 45 ohms cm to 55 ohms cm.

REACTION CONDITIONS

MATRIX=Steel
ELECTRODE=Platinum
ELECTRODE COVER=Nylon cloth
FREQUENCY=13.7 KHz
RATE OF APPLICATION=2466 mm/minute
TIME OF APPLICATION=2 minutes Observation with the optical and scanning electron microscope revealed a surface deposition of cadmium approximately 1 um thick. The surfce of the deposit was irregular but it was solid and continuous as seen from FIG. 37.

An SEM/EPMA scan across the interface indicated fusion of cadmium to a depth of at least 4 um as shown on the Table below and FIG. 38.

| DEPTH μm | ELEMENT | CONCENTRATION (Wt %) |
|---|---|---|
| 0.5 | Cd | 73.3 |
| 1.0 | Cd | 8.8 |
| 2.0 | Cd | 1.4 |
| 3.0 | Cd | 1.2 |
| 4.0 | Cd | 1.1 |

EXAMPLE XVIII

An aqueous solution of the following formulation was prepared:

| NAME | GRAMS/LITER |
|---|---|
| Stannous chloride | 77.3 |
| Sodium hydroxide | 66.0 |
| Sodium acetate | 14.7 |

-continued

| NAME | GRAMS/LITER |
|---|---|
| Water (distilled) | 1000 ml. |

This solution had the following characteristics:

pH=12.4

Resistivity=8.6 ohms cm.

Concentration of $Sn^{+2}$ ions=4% by weight

The pH may be varied from 11.2 to 12.7; the concentration of $Sn^{+2}$ ions may vary from 2% to 5% by weight; and the resistivity from 6.2 ohms cm to 10.3 ohms cm.

REACTION CONDITIONS

MATRIX=Copper
ELECTRODE=Graphite
ELECTRODE COVER=Cotton gauze
FREQUENCY=9.85 KHz
RATE OF APPLICATION=1773 mm/minute
TIME OF APPLICATION=2 minutes Observation with the optical and scanning electron microscope revealed a surface deposition of tin approximately 1.2 um thick. The deposit was uniformly thick and homogenous. This is shown in FIG. 39.

An SEM/EPMA scan across the interface indicated fusion of tin to a depth of at least 4 um as shown on the table below and FIG. 40.

| DEPTH μm | ELEMENT | CONCENTRATION (Wt %) |
|---|---|---|
| 1 | Sn | 91.4 |
| 2 | Sn | 4.4 |
| 3 | Sn | 0.9 |
| 4 | Sn | 0.5 |

EXAMPLE XIX

An aqueous solution of the following formulation was prepared:

| NAME | GRAMS/LITER |
|---|---|
| Stannous chloride | 9.4 |
| Tetrasodium pyrophosphate | 44.7 |
| Dextrine | 6.25 |
| Water (distilled) | 1000 ml |
| Sodium lauryl sulphate | 0.5 |

This solution had the following characteristics:

pH=9.05

Resistivity=34 ohms cm.

Concentration of $Sn^{+2}$=0.50% by weight

The pH may be varied from 9 to 9.7; the concentration of $Sn^{+2}$ ions may vary from 0.4% to 1% by weight; and the resistivity from 30 ohms cm to 36 ohms cm.

REACTION CONDITIONS

MATRIX=Copper
ELECTRODE=Graphite
ELECTRODE COVER=Cotton gauze
FREQUENCY=9.85 KHz
RATE OF APPLICATION=1773 mm/minute
TIME OF APPLICATION=2 minutes Observation with the optical and scanning electron microscope revealed a surface deposition of tin approximately 4 um thick. This deposit appears to comprise a lower uniform and substantially homogenous layer of approximately 1 um thick and an outer slightly porous layer approximately 3 um thick as shown in FIG. 41.

Figure 47:
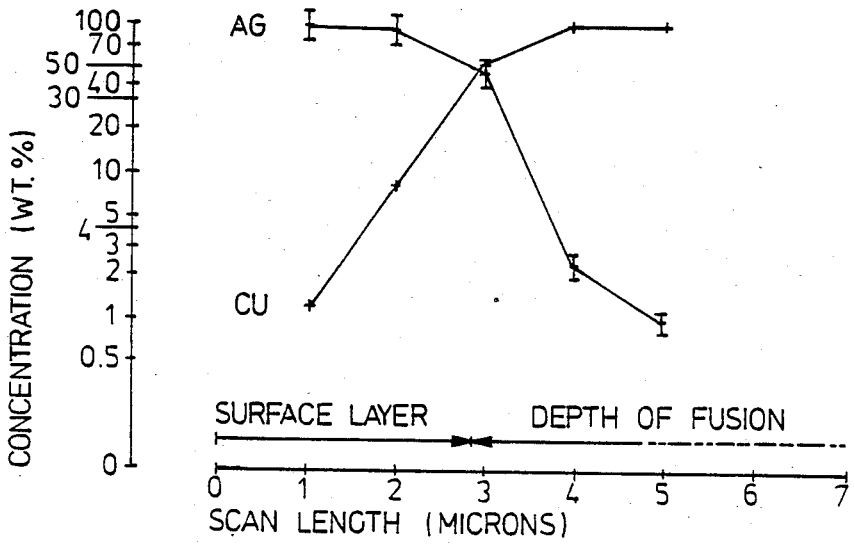

An SEM/EPMA scan across the interface indicated fusion of tin to a depth of at least 5 um as shown on the Table below and FIG. 47.

| DEPTH μm | ELEMENT | CONCENTRATION (Wt %) |
|---|---|---|
| 1 | Sn | 97 |
| 2 | Sn | 97.3 |
| 3 | Sn | 94.3 |
| 5 | Sn | 1.0 |

EXAMPLE XX

An aqueous solution of the same as prepared for Example XIX was employed:

REACTION CONDITIONS

MATRIX=Steel (ASA 1010)
ELECTRODE=Graphite
ELECTRODE COVER=Cotton gauze
FREQUENCY=10.61 KHz
RATE OF APPLICATION=1909.8 mm/minute
TIME OF APPLICATION=3 minutes Observation with the optical and scanning electron microscope revealed a surface deposition of tin exceeding 2 um thick. This layer was porous but continuous as shown in FIG. 43.

An SEM/EPMA scan across the interface indicated fusion of tin to a depth of at least 2 um as shown on the table below and FIG. 44.

| DEPTH μm | ELEMENT | WT % |
|---|---|---|
| 0.5 | Sn | 96.2 |
| 1.0 | Sn | 81.4 |
| 2.0 | Sn | 2.5 |

EXAMPLE XXI

An aqueous solution of the following formulation was prepared:

| NAME | GRAMS/LITER |
|---|---|
| Cobaltous sulphate | 252 |
| Sodium fluoride | 14 |
| Boric acid | 45 |
| Dextrose | 5 |
| Sodium lauryl sulphate | 0.2 |
| Water (distilled) | 1000 ml |

This solution had the following characteristics:

pH=6.03

Resistivity=28.5 ohms cm.

Concentration of $Co^{+2}$=5.3% by wt.

The pH may be varied from 4.5 to 6.5; the concentration of $Co^{+2}$ ions may vary from 2% to 6% by weight; and the resistivity from 25 ohms cm to 30 ohms cm.

REACTION CONDITIONS

MATRIX=Copper
ELECTRODE=Platinum
ELECTRODE COVER=Nylon mesh
FREQUENCY=5.1 KHz
RATE OF APPLICATION=918 mm/minute
TIME OF APPLICATION=3.0 minutes Observation with the optical and scanning electron microscope revealed a surface deposition of cobalt approximately 6.5 um thick. This layer was uniform and continuous as shown in FIG. 45.

An SEM/EPMA scan across the interface indicated fusion of cobalt to a depth of at least 20 um as shown on the Table below and FIG. 46.

| DEPTH μm | ELEMENT | CONCENTRATION (Wt %) |
|---|---|---|
| 10 | Co | 2.65 |
| 15 | Co | 1.6 |
| 20 | Co | 0.87 |
| 25 | Co | 0.44 |

It was evident by visual inspection and from the previous experiments that the deposit of cobalt was above the 10 um level was extremely dense.

EXAMPLE XXII

An aqueous solution of the following formulation was prepared:

| NAME | GRAMS/LITER |
|---|---|
| Silver cyanide | 26 |
| Potassium cyanide | 46 |
| Potassium carbonate | 37 |
| Sodium lauryl sulphate | 1 |
| Carbon disulphide | 1–2 |
| Water (distilled) | 1000 ml. |

This solution had the following characteristics:

pH=11.55

Resistivity=10.5 ohms cm.

Concentration of $Ag^{+1}$=2.09% by wt.

The pH may be varied from 11.2 to 11.7; the concentration of $Ag^{+1}$ ions may vary from 1% to 3% by weight; and the resistivity from 8 ohms cm to 13 ohms cm.

REACTION CONDITIONS

MATRIX=Copper
ELECTRODE=Platinum
ELECTRODE COVER=Nylon
FREQUENCY=7.7 KHz.
RATE OF APPLICATION=1386 mm/minute
TIME OF APPLICATION=1.0 minute Observation with the optical and scanning electron microscope revealed a surface deposition of silver approximately 5 um thick. The structure is shown in FIGS. 47 and 47A.

An SEM/EPMA scan across the interface indicated fusion of silver to a depth of at least 3 um as shown on the Table below and FIG. 48.

| DEPTH μm | ELEMENT | CONCENTRATION (Wt %) |
|---|---|---|
| 1 | Ag | 98.7 |
| 2 | Ag | 91.4 |
| 3 | Ag | 46.3 |
| 4 | Ag | 2.4 |
| 5 | Ag | 1.0 |

EXAMPLE XXIII

An aqueous solution of the following formulation was prepared:

| NAME | GRAMS/LITER |
|---|---|
| Silver nitrate | 29 |
| Potassium iodide | 398 |
| Citric acid | 6 |
| Dextrose | 5 |
| Carbon disulfide | 1.5 |
| Ammonium hydroxide | to pH |
| Water (distilled) | 1000 ml. |

This solution had the following characteristics:

pH=5.6

Resistivity=6.6 ohms cm.

Concentration of $Ag^{+1}$=1.84%

The pH may be varied from 1.5 to 2; the concentration of $Ag^{+1}$ ions may vary from 0.5% to 2.5% by weight; and the resistivity from 6 ohms cm to 12 ohms cm.

REACTION CONDITIONS

MATRIX=Copper
ELECTRODE=Graphite
ELECTRODE COVER=Cotton gauze
FREQUENCY=9.5 KHz.
RATE OF APPLICATION=1710 mm/minute
TIME OF APPLICATION=2.0 minutes Observation with the optical and scanning electron microscope revealed a surface deposition of silver approximately 2 um thick. The structure was as shown in FIG. 49.

An SEM/EPMA scan across the interface indicated fusion of silver to a depth of at least 2.00 um as shown on the Table below and FIG. 50.

| DEPTH μm | ELEMENT | CONCENTRATION (WT %) |
|---|---|---|
| 1 | Ag | 97.7 |
| 2 | Ag | 97.5 |
| 3 | Ag | 28.0 |
| 4 | Ag | 3.8 |
| 5 | Ag | 2.8 |
| 6 | Ag | 1.0 |

From the foregoing examples it will be seen that through the medium of these solutions a second metal in the solution may be fused with a first metal.

We claim:

1. A solution for the fusion of a second metal to a first metal consisting essentially of:

0.10 to 10% by weight of a first compound including said second metal in a dissociable polyvalent form;

0.30 to 10% by weight of a second compound capable of complexing with the first compound, the first compound and the second compound being either soluble in water or forming a complex which is soluble in water;

0.1 to 0.5% by weight of a stabilizing agent which maintains the first compound, the second compound and the complex thereof in solution;

0.1 to 0.5% by weight of a catalyzer for promoting the speed of reaction, reducing the valency of the polyvalent form of said second metal to a lower valency and catalyzing complexing action between the first and second compound; and the remainder a solvent selected from the group consisting of water, an organic solvent or a mixture thereof whereby said solution has a resistivity in the range of 10 to 80 ohms cm at room temperature.

2. A solution as claimed in claim 1 wherein said stabilizing agent is selected from the group consisting of boric acid, citric acid, citrates, pyrophosphates, acetates and aluminum sulphate.

3. A solution as claimed in claim 1 wherein said catalyzing agent is selected from the group consisting of metallic ions including iron, nickel, anitmony and zinc and organic compounds including dextrine, hydroquinone, gelatin, pepsin and acacia gum.

4. A solution as claimed in claim 2 wherein said catalyzing agent is selected from the group consisting of metallic ions including iron, nickel, antimony and zinc and organic compounds including dextrine, hydroquinone, gelatin, pepsin and acacia gum.

5. A solution as claimed in claim 4 wherein the second compound is selected from the group consisting of one of pyrophosphates, ethylene diamine tetracetic acid, citric acid, and potassium iodide and the like, the pyrophosphates also serving as the stabilizing agent.

6. A solution as claimed in claim 5 wherein the dissociable polyvalent form of said second metal is selected from the group consisting of metallic salts or acids and comprising sodium molybdate, sodium tungstate, indium sulphate, nickelous sulphate, nickelous chloride, chloroauric acid, chromium trioxide, chromium sulphate, chromic chloride, cadmium chloride, cadmium sulphate, stannous chloride cobaltous sulphate, silver cyanide, silver nitrate.

7. A solution as claimed in claim 5 further including a wetting agent and surfactants.

8. A solution as claimed in claim 1 wherein the first metal is selected from the group consisting of molybdenum, tungsten, indium, nickel, gold, chromium, silver, cadmium, tin, cobalt and silver.

9. A solution as claimed in claim 4 wherein the solution has a pH in the range of 0.4 to 14.

10. A solution for the fusion of a second metal to a first metal consisting essentially of:

0.10 to 10% by weight of a first compound including said second metal in a dissociable form;

at least one of a stabilizing agent which maintains the first compound and a catalyzer for promoting the speed of reaction; and a solvent selected from the group comsisting of water, an organic solvent or a mixture thereof whereby said solution has a resistivity in the range of 10 to 80 ohms cm at room temperature.

11. A solution as claimed in claim 10 wherein said solvent is water and said solution has a pH in the range 0.4 to 14.

12. A solution as claimed in claim 11 wherein said solution further includes a second metal complexing agent.

13. A solution as claimed in claim 12 wherein said solution further includes both the stabilizing agent for maintaining either the first compound and said second metal or the complex thereof in solution and the catalyzer.

14. A solution as claimed in claim 13 further including a wetting agent.

15. A solution as claimed in claim 14 wherein said second metal is present as a salt or an acid thereof.

16. A solution as claimed in claim 15 wherein said second metal complexing agents are selected from the group consisting of organic acids, organic salts and halogen salts.

17. A solution as claimed in claim 13 wherein said stabilizing agents are chosen from the group consisting of organic salts or inorganic salts.

18. A solution as claimed in claim 13 wherein said catalyzing agent is selected from the group consisting of metallic ions.

19. A solution as claimed in claim 18 wherein said catalyzing agent is selected from the group consisting of a soluble organic compound selected from the group consisting of dextrine, hydroquinone, gelatin, pepsin or acacia gum.

* * * * *